US008398195B2

(12) United States Patent
Kondo et al.

(10) Patent No.: US 8,398,195 B2
(45) Date of Patent: Mar. 19, 2013

(54) METHOD FOR DETECTING ADJUSTMENT VALUE OF FLUID EJECTION DEVICE, AND FLUID EJECTION DEVICE

(75) Inventors: Takamitsu Kondo, Nagano (JP); Toru Takahashi, Nagano (JP); Hiroshi Wada, Nagano (JP); Kazuyoshi Tanase, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 91 days.

(21) Appl. No.: 13/078,288

(22) Filed: Apr. 1, 2011

(65) Prior Publication Data

US 2011/0273499 A1 Nov. 10, 2011

(30) Foreign Application Priority Data

May 7, 2010 (JP) ..... 2010-107004

(51) Int. Cl.
*B41J 29/38* (2006.01)

(52) U.S. Cl. ..... 347/10

(58) Field of Classification Search ..... 347/9–12, 347/19, 40

See application file for complete search history.

(56) References Cited

U.S. PATENT DOCUMENTS

| | | | | |
|---|---|---|---|---|
| 7,524,009 | B2 * | 4/2009 | Chiwata | 347/15 |
| 7,918,521 | B2 * | 4/2011 | Furuya et al. | 347/10 |
| 2006/0197791 | A1 | 9/2006 | Iriguchi et al. | |
| 2006/0214960 | A1 | 9/2006 | Chiwata | |
| 2011/0234676 | A1 * | 9/2011 | Nishikawa | 347/19 |

FOREIGN PATENT DOCUMENTS

| | | | |
|---|---|---|---|
| JP | 2005-132034 | A | 5/2005 |
| JP | 2006-240127 | A | 9/2006 |
| JP | 2006-264069 | A | 10/2006 |

* cited by examiner

*Primary Examiner* — An Do

(74) *Attorney, Agent, or Firm* — Global IP Counselors, LLP

(57) ABSTRACT

An adjustment method is a method for adjusting a fluid ejection device having first and second heads with the first head disposed on an upstream side of the second head in a feed direction in which a medium is conveyed, the second head forming dot rows of a fluid between dot rows of the fluid formed by the first head. The first head and the second head are driven with a first voltage change amount to form a first test pattern, and the first head and the second head are driven with a second voltage change amount to form a second test pattern.

9 Claims, 21 Drawing Sheets

| | First Band | | | |
|---|---|---|---|---|
| | Black | Cyan | Magenta | Yellow |
| Vh1 | 74.43 | 131.50 | 149.45 | 90.49 |
| Vh2 | 84.32 | 140.58 | 156.64 | 98.27 |

| | Second Band | | | |
|---|---|---|---|---|
| | Black | Cyan | Magenta | Yellow |
| Vh1 | 75.39 | 132.34 | 149.83 | 90.77 |
| Vh2 | 85.51 | 140.13 | 156.49 | 98.27 |

| | Third Band | | | |
|---|---|---|---|---|
| | Black | Cyan | Magenta | Yellow |
| Vh1 | 73.37 | 130.09 | 147.16 | 88.69 |
| Vh2 | 82.98 | 138.93 | 155.11 | 96.98 |

Fig. 11

| Black | Cyan | Magenta | Yellow |
|---|---|---|---|
| 80.39 | 136.19 | 152.34 | 94.47 |

Fig. 12

| | | Black | Cyan | Magenta | Yellow |
|---|---|---|---|---|---|
| First Band | a | 3.30 | 3.03 | 2.40 | 2.59 |
| | b | 1.90 | 64.9 | 96.7 | 33.4 |
| Second Band | a | 3.37 | 2.59 | 2.22 | 2.50 |
| | b | 1.18 | 75.2 | 101 | 35.8 |
| Third Band | a | 3.20 | 2.95 | 2.65 | 2.76 |
| | b | 2.90 | 65.3 | 88.9 | 27.9 |

Fig. 13

| | Black | Cyan | Magenta | Yellow |
|---|---|---|---|---|
| First Band | 23.78 | 23.52 | 23.18 | 23.58 |
| Second Band | 23.50 | 23.55 | 23.12 | 23.47 |
| Third Band | 24.22 | 24.03 | 23.93 | 24.12 |

Fig. 14

| | |
|---|---|
| First Band | 23.52 |
| Second Band | 23.41 |
| Third Band | 24.08 |

Fig. 15

| | ALLOCATION COEFFICIENT |
|---|---|
| FIRST HEAD | 1.0 |
| SECOND HEAD | 1.0 |
| THIRD HEAD | 1.2 |
| FOURTH HEAD | 0.8 |
| FIFTH HEAD | 0.7 |
| SIXTH HEAD | 1.3 |

Fig. 16

| | |
|---|---|
| FIRST HEAD | 23.52 |
| SECOND HEAD | 23.52 |
| THIRD HEAD | 28.09 |
| FOURTH HEAD | 18.73 |
| FIFTH HEAD | 16.86 |
| SIXTH HEAD | 31.30 |

Fig. 17

BLACK INK

YELLOW INK

MAGENTA INK

CYAN INK

| | CONCENTRATION CORRECTION VALUE | | | | |
|---|---|---|---|---|---|
| RASTER LINE | Ha | Hb | Hc | Hd | He |
| 1 | | | | | |
| 2 | | | | | |
| 3 | | | | | |
| 4 | | | | | |
| 5 | | | | | |
| 6 | | | | | |
| 7 | | | | | |
| 8 | | | | | |
| 9 | | | | | |
| 10 | | | | | |
| ⋮ | | | | | |

Fig. 26

METHOD FOR DETECTING ADJUSTMENT VALUE OF FLUID EJECTION DEVICE, AND FLUID EJECTION DEVICE

CROSS-REFERENCE TO RELATED APPLICATIONS

This application claims priority to Japanese Patent Application No. 2010-107004 filed on May 7, 2010. The entire disclosure of Japanese Patent Application No. 2010-107004 is hereby incorporated herein by reference.

BACKGROUND

1. Technical Field

The present invention relates to a method for detecting an adjustment value of a fluid ejection device, and also relates to a fluid ejection device.

2. Related Art

Line head printers have been developed which perform printing by conveying a medium beneath a plurality of heads fixed to a printer and ejecting a fluid from the heads.

In the heads used in such printers, the optimal drive waveform and drive voltage differ for each head, and their values must be adjusted for each head. One example of a method for setting the optimal drive waveform and drive voltage for each head is the method disclosed in Japanese Laid-Open Patent Publication No. 2006-240127. The method disclosed in Japanese Laid-Open Patent Publication No. 2006-264069 is a method for performing a concentration correction process.

When there are large variations in output for each head even with these methods, there have been cases in which the drive voltage and the like cannot be appropriately adjusted. In one method for resolving such problems, a concentration of test patterns is determined when a plurality of drive voltages are applied, and the drive voltage is adjusted so that these test patterns have a reference concentration, whereby the concentrations outputted by the heads become substantially uniform.

SUMMARY

In a line head printer, heads are disposed in the upstream and downstream sides of the medium feed direction in order to increase the printable dot pitch. At this time, the printable dot pitch is increased by disposing the two heads so that the nozzles in the heads are misaligned by ½ of a nozzle pitch in a direction intersecting the feed direction.

However, when an attempt is made to adjust the voltage applied to the heads based on the test pattern formed by only one of the heads between the upstream head and the downstream head, there are cases in which the concentration of the test patterns cannot be appropriately detected, and as a result, the voltages applied to the heads cannot be appropriately adjusted. For example, printers capable of printing in a resolution of 720 dpi using an upstream head and a downstream head have had problems in that when only the upstream head is used to print a test pattern in a resolution of 360 dpi, there is a strongly apparent effect of banding due to the effect of nozzle deflection or the like, and a stable concentration cannot be determined. Consequently, it is preferable to appropriately adjust the voltage applied to the head based on the test patterns under such conditions.

The present invention was devised in view of such circumstances, and an object thereof is to appropriately adjust the voltages applied to the heads based on the test patterns.

A detection method according to one aspect of the present invention is a method for detecting adjustment values of a fluid ejection device having first and second heads with the first head disposed on an upstream side of the second head in a feed direction in which a medium is conveyed, the second head forming dot rows of a fluid between dot rows of the fluid formed by the first head, the detection method including: driving the first head and the second head with a first voltage change amount to form a first test pattern and driving the first head and the second head with a second voltage change amount to form a second test pattern; measuring a concentration of the first test pattern and a concentration of the second test pattern; and detecting a voltage change amount for driving the first head and a voltage change amount for driving the second head based on the concentration of the first test pattern and the concentration of the second test pattern.

Other characteristics of the present invention will be made clear from the Specification and the descriptions of the accompanying drawings.

BRIEF DESCRIPTION OF THE DRAWINGS

Referring now to the attached drawings which form a part of this original disclosure:

FIG. 11 is a table showing the average concentrations of the determined bands and ink colors for each drive voltage;

FIG. 12 is a table showing the reference concentrations of the ink colors;

FIG. 13 is a table showing determined coefficients a and b of a primary expression;

FIG. 14 is a table showing the proper drive voltage of each ink color of each band;

FIG. 15 is a table showing the proper drive voltage of each band;

FIG. 16 is a table showing allocation coefficients of the heads;

FIG. 17 is a table showing the proper drive voltages of the heads;

FIG. 26 is a diagram showing a correction value table stored in a memory 63.

DETAILED DESCRIPTION OF EXEMPLARY EMBODIMENTS

Figure 1:
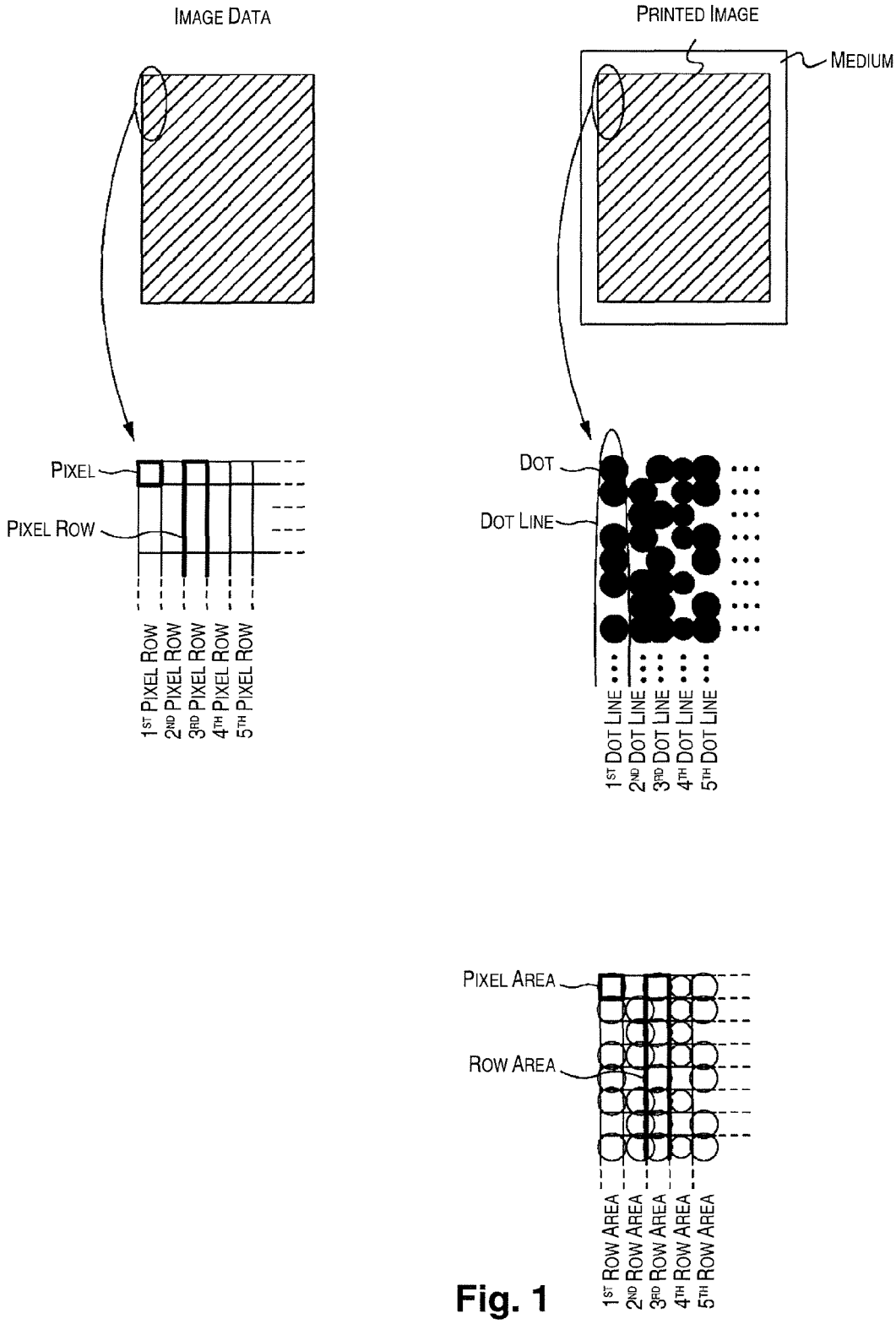
FIG. 1 is an explanatory drawing of the terminology.

At least the following items will be made clear from the Specification and the descriptions of the accompanying drawings.

Disclosed herein is a detection method for detecting adjustment values of a fluid ejection device having first and second heads with the first head disposed on an upstream side of the second head in a feed direction in which a medium is conveyed, the second head forming dot rows of a fluid between dot rows of the fluid formed by the first head, the detection method including: driving the first head and the second head with a first voltage change amount to form a first test pattern and driving the first head and the second head with a second voltage change amount to form a second test pattern; measuring a concentration of the first test pattern and a concentration of the second test pattern; and detecting a voltage change amount for driving the first head and a voltage change amount for driving the second head based on the concentration of the first test pattern and the concentration of the second test pattern.

By this method, the voltages applied to the heads can be appropriately adjusted based on the test patterns.

In this detection method, the step of detecting the voltage change amount for driving the first head and the voltage change amount for driving the second head preferably includes determining the voltage change amount corresponding to a target concentration based on the concentration of the first test pattern and the concentration of the second test pattern. The voltage change amount for driving the first head and the voltage change amount for driving the second head may be detected based on the voltage change amount corresponding to the target concentration, and an allocation coefficient determined in advance based on the relative fluid ejection amounts of the first head and the second head. Furthermore, the allocation coefficient is preferably determined based on the weights of the fluid ejected by the first head and the second head. The allocation coefficient may also be determined based on the widths of ruled lines formed by the first head and the second head. The voltage change amounts are preferably amplitudes of drive pulses included in drive signals for driving the heads. The voltage change amounts may also be the maximum amplitudes of the drive pulses included in the drive signals for driving the heads.

The first test pattern and the second test pattern are preferably test patterns with which dots are formed in all of the pixels in a predetermined area. Also preferably included are the steps of forming a corrective pattern on the medium to correct the concentrations in each pixel row composed of pixels aligned in the feed direction, and determining concentration correction values for correcting the concentrations of each pixel row based on the corrective pattern; wherein the concentration of the formed corrective pattern is measured for each pixel row, and the concentration correction values are determined based on the measured concentrations of each pixel row.

By this method, the voltages applied to the heads can be appropriately adjusted based on the test patterns.

A fluid ejection device includes a first head disposed on an upstream side in a feed direction in which a medium is conveyed, and a second head disposed on a downstream side of the first head, the second head being configured to form dot rows of a fluid between dot rows of the fluid formed by the first head. The fluid ejection device is adjusted according to the adjustment values detected by the detection method according the embodiment.

By designing the device in this manner, the voltages applied to the heads can be appropriately adjusted based on the test patterns.

EMBODIMENTS

Description of Terminology

First is a description of the meanings of the terminology used when describing the present embodiment.

FIG. 1 is an explanatory drawing of the terminology.

The term "printed image" refers to an image printed on paper. The printed image of the inkjet printer is configured from innumerable dots formed on the paper.

The term "dot line" refers to a row of dots aligned in the direction in which the heads and paper move relative to each other (the movement direction). In the case of a line printer such as the one in the embodiment described hereinafter, the term "dot line" means a row of dots aligned in the paper feed direction. In the case of a serial printer which prints through heads mounted on a carriage, the term "dot line" means a row of dots aligned in the movement direction of the carriage. A printed image is configured by aligning numerous dot lines in the direction perpendicular to the movement direction. The dot line in the nth position is referred to as the "nth dot line," as shown in the drawings.

The term "image data" refers to data representing two-dimensional images. In the embodiment described hereinafter, there is 256 tone image data, 2 tone image data, 4 tone image data, and so on. The term "image data" also indicates image data before it is converted to a print resolution described hereinafter, as well as image data after it is converted.

The term "print image data" refers to image data used when an image is printed on the paper. When the printer controls the formation of dots in 2 tones, the 2 tone print image data will indicate whether or not there are dots in the pixels. When the printer controls the formation of dots in 4 tones (large dots, medium dots, small dots, and no dots), the 4 tone image data will indicate the formation state of the dots constituting the printed image.

The term "read image data" refers to image data that has been read by a scanner.

The term "pixel" refers to the minimum unit constituting the image. An image is configured by pixels being arranged two-dimensionally.

The term "pixel row" refers to a row of pixels aligned in a predetermined direction in the image data. The nth numbered pixel row is referred to as the "nth pixel row" as shown in the drawings.

The term "pixel data" refers to data indicating the tone values of pixels. In the embodiment described hereinafter, this term indicates multi-tone data such as 256 tone data if the halftone process has not yet been performed. In the case of 2 tone print image data after the halftone process, the pixel data will be 1 bit data indicating whether or not there are dots in certain pixels. In the case of 4 tone print image data after the halftone process has been performed, the pixel data will be 2 bit data indicating the dot formation state of certain pixels (large dots, medium dots, small dots, and no dots).

The term "pixel area" refers to an area on the paper corresponding to a pixel in the image data. For example, in a case in which the resolution of the print image data is 720×720 dpi, the term "pixel area" refers to a square-shaped area whose edges measure 1/720 of an inch, which is one pixel on the paper.

The term "row area" refers to an area on the paper corresponding to a pixel row, which is a pixel row on the paper. For example, in a case in which the resolution of the print image data is 720×720 dpi, the row area is a long, thin area having a width of 1/720 of an inch. The term "row area" also sometimes refers to an area on the paper corresponding to a pixel row in the print image data, and also sometimes refers to an area on the paper corresponding to a pixel row in the read image data. In the lower right of the drawings, the row area of the former reference is shown. The term "row area" of the former reference is also the target position for forming a dot line. When a dot line is properly formed in the row area, the dot line is equivalent to a raster line. The term "row area" of the latter reference also refers to a measured position (measured range) on the paper where the pixel row in the read image data is read; in other words, a position on the paper where the image (image piece) expressed by the pixel row is located. The row area in the nth position is referred to as the "nth row area" as shown in the drawings. The nth row area is the target position for forming the nth dot line.

The term "image piece" refers to one portion of the image. An image shown by a certain pixel row in the image data is an "image piece" of the image shown by that image data. The image expressed by a certain raster line in the printed image is an "image piece" of the printed image. The image expressed by the coloring in a certain row area in the printed image is also equivalent to the "image piece" of the printed image.

The lower right of FIG. 1 shows the positional relationship between pixel areas and dots. As a result of the second dot line deviating from the second row area due to the effect of a head manufacturing error, the concentration of the second row head is faint. In the fourth row area, as a result of the dots being smaller due to the effect of a head manufacturing error, the concentration of the fourth row area is faint. Since such concentration discrepancies and the method for correcting concentration discrepancies must be described, they are described in the present embodiment in accordance with the meanings and relationships of the terms "dot line," "pixel row," "row area," etc.

The meanings of the terms "image data," "pixels," and other common terminology are not limited to the above descriptions and may be suitably interpreted according to common knowledge of the related art.

In the descriptions hereinbelow, the concentration is high when the tone value is high, and the concentration is low when the tone value is low. Also in the descriptions, cases of high concentration correspond to cases of low brightness.

Print System

Figure 2:
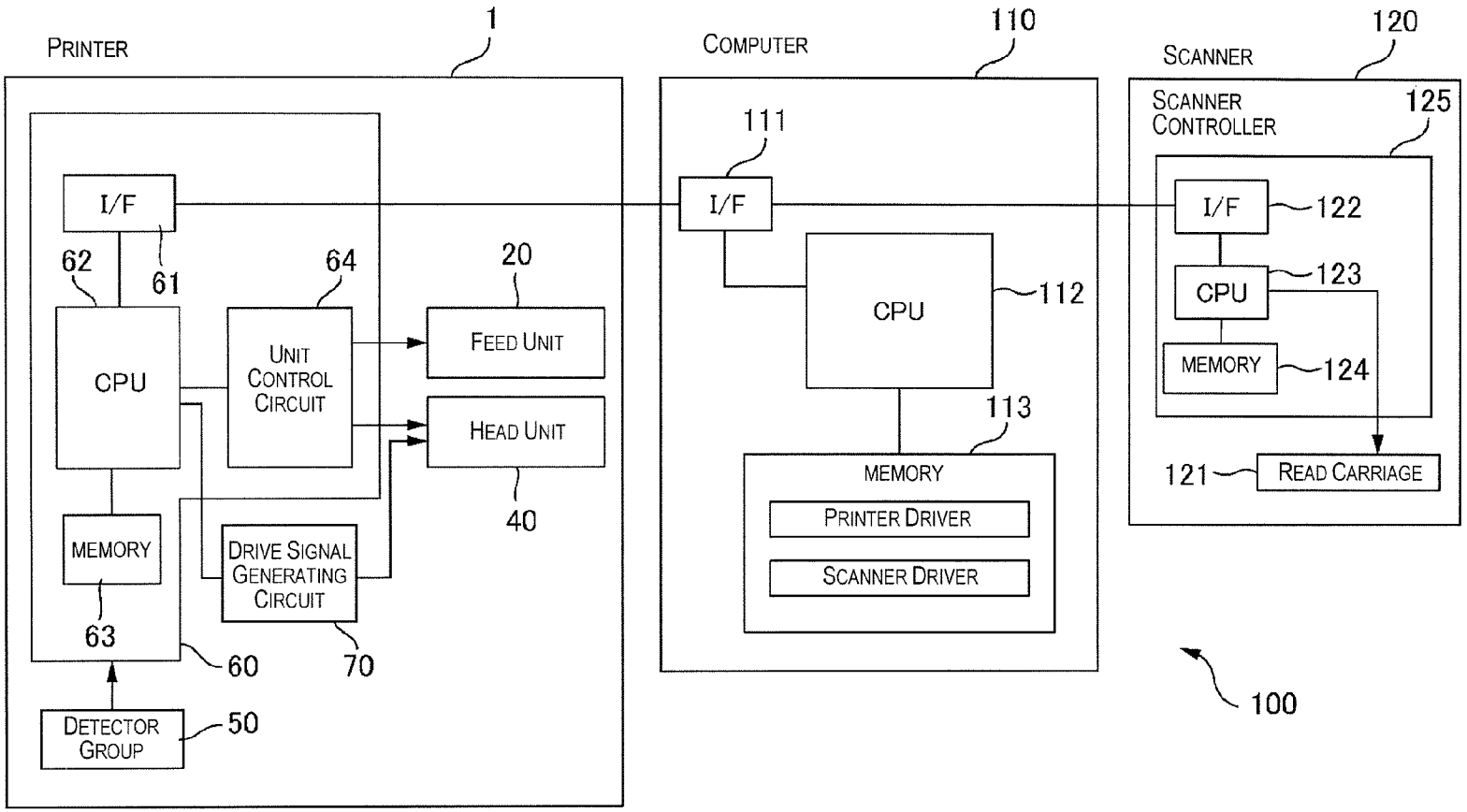
FIG. 2 is a block diagram showing the configuration of a print system 100.

FIG. 2 is a block diagram showing the configuration of a print system 100. The print system 100 of the present embodiment is a system which has a printer 1, a computer 110, and a scanner 120, as shown in FIG. 2.

The printer 1 is a fluid ejection device which ejects ink as a fluid onto a medium to form (print) an image on the medium, and is a color inkjet printer in the present embodiment. The printer 1 is capable of printing images on paper, cloth, film sheets, and other various media. The configuration of the printer 1 will be described hereinafter.

The computer 110 has an interface 111, a CPU 112, and memory 113. The interface 111 conducts the receiving and transferring of data between the printer 1 and the scanner 120. The CPU 112 performs overall control on the computer 110 and executes various programs installed in the computer 110. The memory 113 stores various programs and various data. The programs installed in the computer 110 include a printer driver for converting the image data outputted from an application program into print data, and a scanner driver for controlling the scanner 120. The computer 110 outputs the print data created by the printer driver to the printer 1.

The scanner 120 has a scanner controller 125 and a reading carriage 121. The scanner controller 125 has an interface 122, a CPU 123, and memory 124. The interface 122 conducts communication with the computer 110. The CPU 123 performs overall control on the scanner 120. For example, the CPU 123 controls the reading carriage 121. The memory 124 stores computer programs and the like. The reading carriage 121 has three sensors (CCDs or the like, not shown) corresponding to the colors R (red), G (green), and B (blue), for example.

In the configuration described above, the scanner 120 radiates light onto a manuscript placed on a manuscript stand (not shown), detects the reflected light by sensors of the reading carriage 121, and reads an image of the manuscript, acquiring color information of the image. Data (read data) expressing the color information of the image is sent to the scanner driver of the computer 110 via the interface 122.

Configuration of Printer

Figure 3:
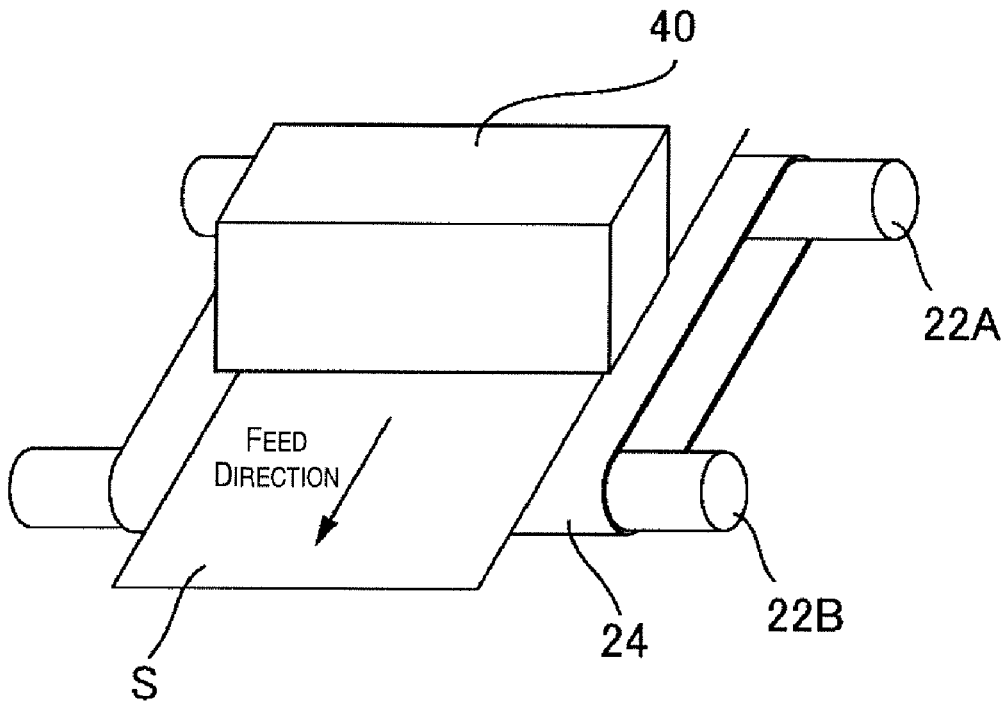
FIG. 3 is a perspective view for describing the conveying process and the dot formation process of the printer 1.

FIG. 3 is a perspective view for describing the conveying process and the dot formation process of the printer 1. The configuration of the printer is described here referring also to the block diagram of FIG. 2.

The printer 1 has a feed unit 20, a head unit 40, a detector group 50, and a controller 60. The controller 60 includes an interface 61 for connecting with the computer 110, a CPU 62 as a computation device, memory 63 equivalent to a storage unit, and a unit control circuit 64 for controlling the units.

The printer 1, having received print data from the computer 110 which is an external device, then controls the units (the feed unit 20 and the head unit 40) through the controller 60. The controller 60 controls the units and prints an image on the paper based on the print data received from the computer 110. The internal conditions of the printer 1 are observed by the detector group 50, and the detector group 50 outputs detection results to the controller 60. The controller 60 controls the units based on the detection results outputted from the detector group 50.

The purpose of the feed unit 20 is to convey the medium (e.g. the paper S or the like) in a predetermined direction (hereinbelow referred to as the feed direction). The feed unit 20 has an upstream roller 22A, a downstream roller 22B, and a belt 24. When a conveying motor (not shown) rotates, the upstream roller 22A and the downstream roller 22B rotate, and the belt 24 also rotates. The paper S fed in is conveyed by the belt 24 to an area where printing can be performed (an area facing the head). The belt 24 conveys the paper S, whereby the paper S moves in the feed direction relative to the head unit 40. Having passed through the printable area, the paper S is ejected to the outside by the belt 24. While being conveyed, the paper S is held to the belt 24 by electrostatic suction or by vacuum suction.

The purpose of the head unit 40 is to discharge ink onto the paper S. Dots are formed on the paper S by the discharge of ink by the head unit 40 onto the paper S being conveyed, and an image is formed on the paper S. The printer 1 of the present embodiment is a line printer, and the head unit 40 is capable of forming dots across the entire width of the paper all at once.

A drive signal generating circuit 70 generates a drive signal to be applied to a piezo element PZT. In the present embodiment, twelve heads are used, from a first head 41A to a twelfth head 41L, and separate drive signals are supplied to each of the heads. A single drive signal is used as a common drive signal for all of the nozzle rows of the head.

The drive signal generating circuit 70 generates and outputs six drive signals COM1 to COM12. The respective amplitudes and other parameters of the drive pulses of the drive signals can be set.

Figure 4:
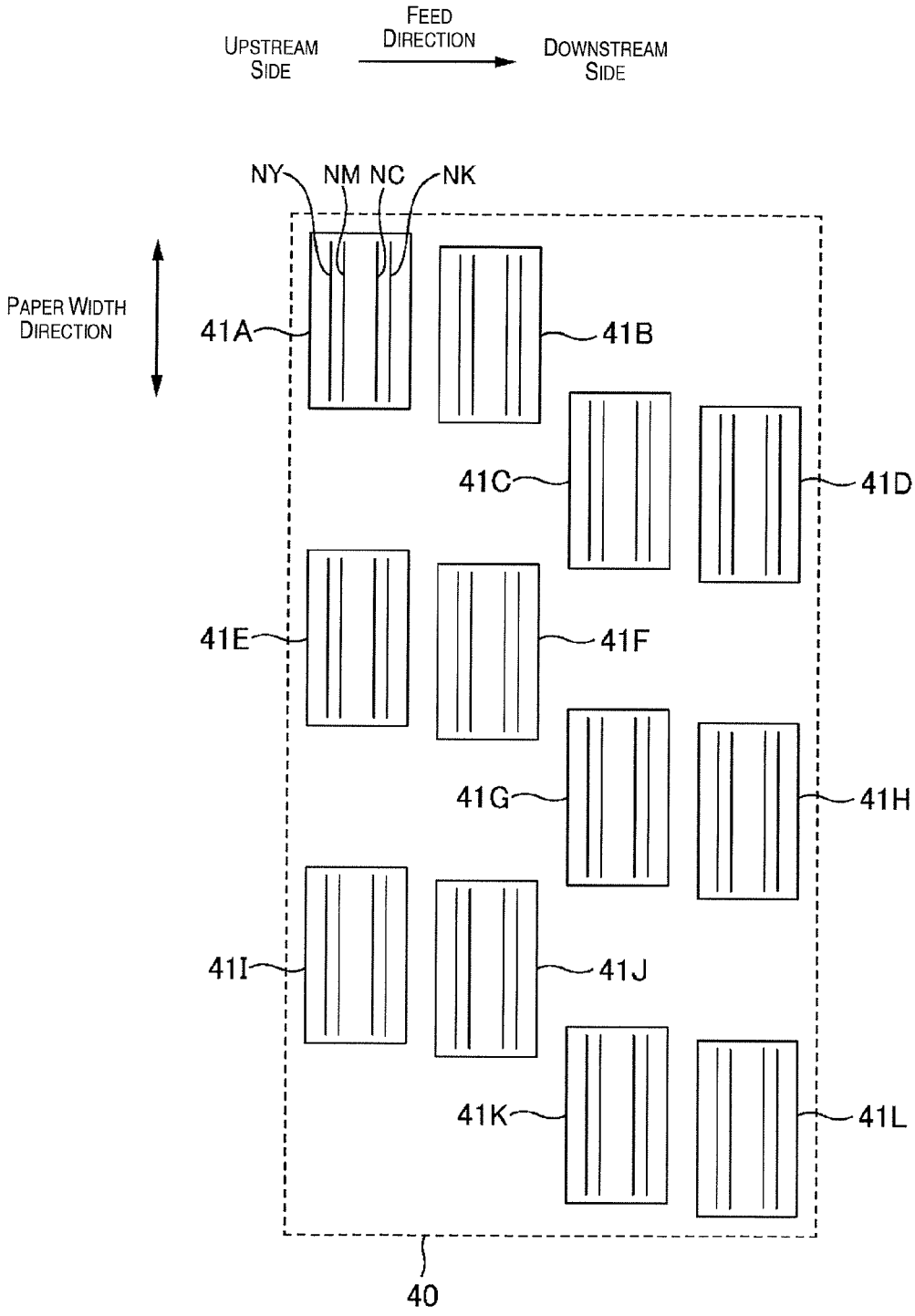
FIG. 4 is an explanatory drawing of the arrangement of the plurality of heads in the head unit 40.

FIG. 4 is an explanatory drawing of the arrangement of the plurality of heads in the head unit 40. Twelve heads 41 are aligned as shown in the drawing. The nozzle rows, which can only be seen from below, are made visible from above in the drawing in order to simplify the description. In the present embodiment, two heads including an upstream head and a downstream head constitute one group, and printing can be performed in the paper width direction at a resolution of 720 dpi. Therefore, the upstream heads and the downstream heads are disposed so as to be misaligned from each other at a nozzle pitch of ½ with respect to the paper width direction. The relationship between the upstream heads and the downstream heads is described hereinafter using FIG. 7.

Formed in each of the heads are a black ink nozzle row NK, a cyan ink nozzle row NC, a magenta ink nozzle row NM, and a yellow ink nozzle row NY. The nozzle rows comprise a plurality (360 in this case) of nozzles for discharging ink. The nozzles of the nozzle rows are aligned along the paper width direction at a constant nozzle pitch (360 dpi in this case). The nozzle rows among the heads are aligned in relation to each other so that the nozzle rows at the ends overlap each other in the feed direction.

Figure 5:
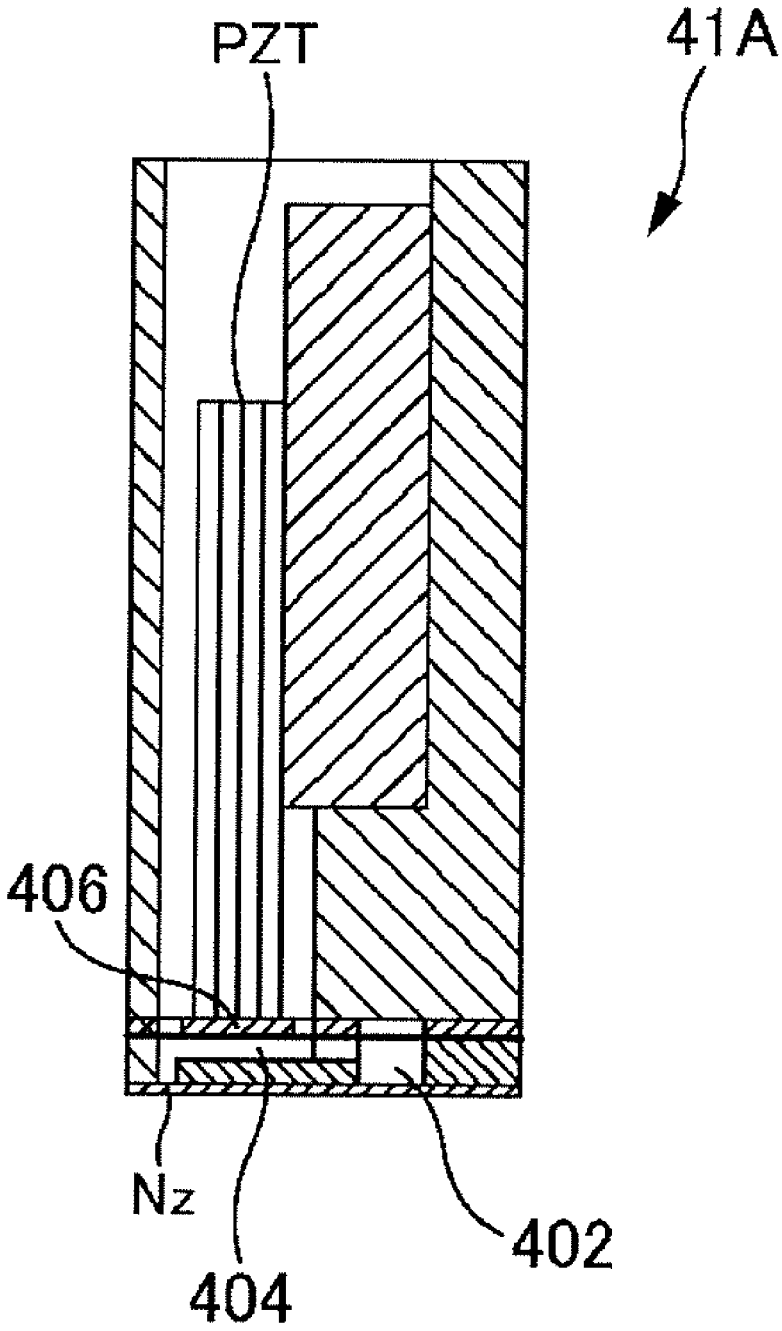
FIG. 5 is a drawing for describing the structure of a head.

FIG. 5 is a drawing for describing the structure of a head. In the present embodiment, first through twelfth heads 41A to 41L are provided. Since the structures of these heads are all substantially identical, only the structure of the first head 41A is described herein. This drawing shows a nozzle Nz, a piezo element PZT, an ink supply channel 402, a nozzle communication channel 404, and an elastic plate 406.

Ink droplets are supplied to the ink supply channel 402 from an ink tank (not shown). These ink droplets or the like are supplied to the nozzle communication channel 404. A drive pulse of a drive signal, described hereinafter, is applied to the piezo element PZT. When the drive pulse is applied, the piezo element PZT expands and contracts according to the signal of the drive pulse, and the elastic plate 406 is vibrated. A quantity of ink droplets corresponding to the amplitude of the drive pulse is discharged from the nozzle Nz.

Figure 6:
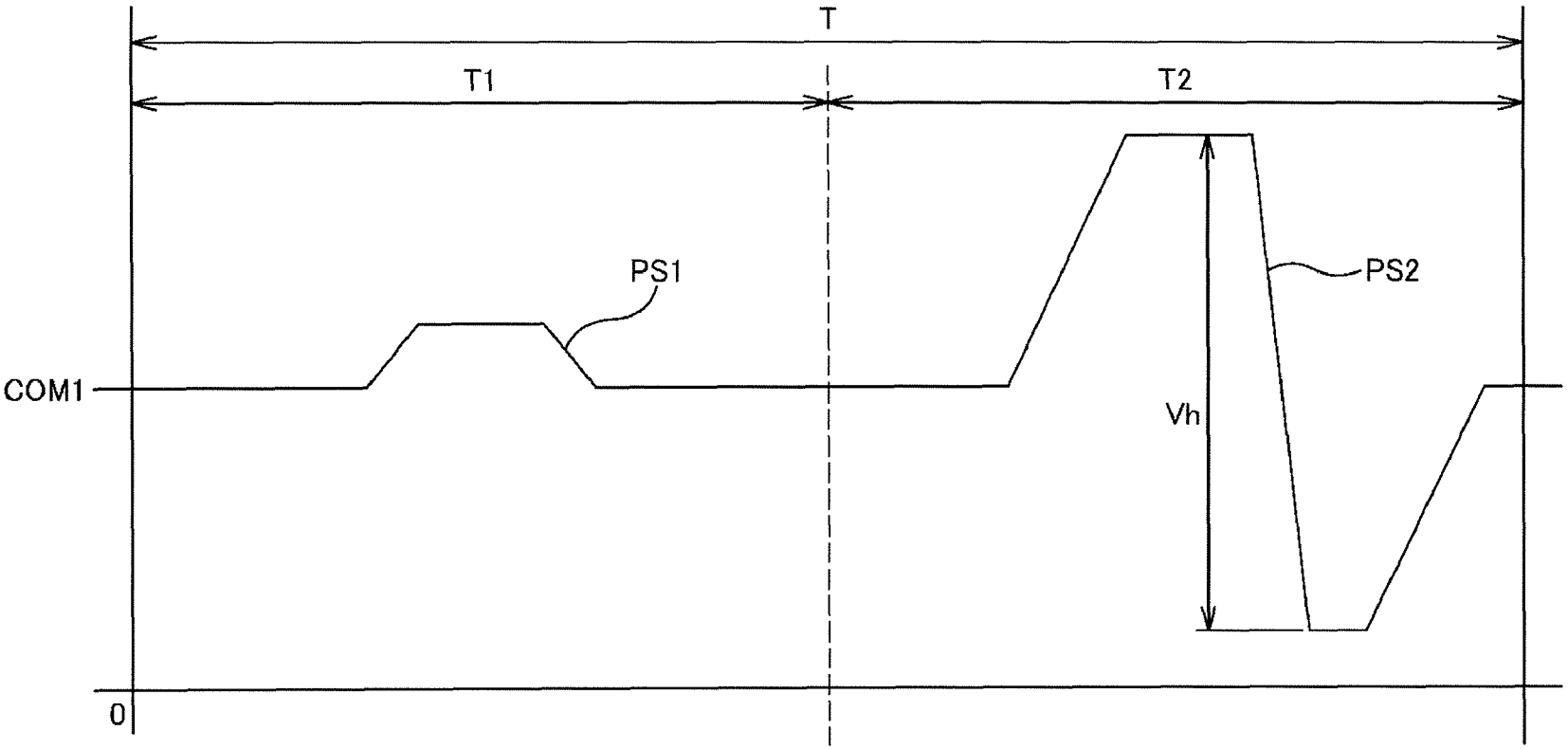
FIG. 6 is a drawing for describing a drive signal.

FIG. 6 is a drawing for describing a drive signal. In the present embodiment, since twelve heads are provided, the drive signals outputted include first through twelfth drive signals COM1 to COM12. In a drive voltage setting process described hereinafter, the amplitude of the second drive pulse PS2 differs slightly among the first through twelfth drive signals COM1 to COM12, but since the shape is substantially the same, the drive signal is described herein using the first drive signal COM1 as an example.

The first drive signal COM1 is repeatedly generated in repeating cycles T. The time duration T of the repeating cycle corresponds to the time duration it takes for the paper S to be conveyed a distance of one pixel area. In a case in which the print resolution in the feed direction is 720 dpi, for example, the time duration T is equivalent to the time duration it takes for the paper S to be conveyed 1/720 of an inch. By applying a drive signal PS1 or PS2 of the intervals included in the time duration T to the piezo element PZT based on the pixel data included in the print data, a dot can either be formed or not formed in one pixel area.

The first drive signal COM1 has a first drive pulse PS1 generated in the interval T1 within the repeating cycle, and a second drive pulse PS2. The first drive pulse PS1 is a minute vibration pulse, and is a drive pulse for minutely vibrating the ink surface of a nozzle (the ink meniscus). When this pulse is applied, ink is not ejected from the nozzle. The second drive pulse PS2 is a pulse for ink ejection, and is a drive pulse for ejecting ink from the nozzle. When this pulse is applied, ink is ejected from the nozzle.

In the diagrams, Vh is shown as the amplitude of the second drive pulse PS2. When the amplitude is increased, ink droplets of a larger size will be ejected, and when the amplitude is reduced, ink droplets of a smaller size will be ejected. Consequently, ink droplets of a desired size can be ejected by setting a revised amplitude through a method described hereinafter. Printing with the desired concentration can then be performed. In the descriptions hereinbelow, the amplitude Vh of the drive pulse for ejecting ink in this manner is equivalent to a "voltage change amount," and is referred to as the drive voltage Vh herein in order to simplify the description.

Figure 7:
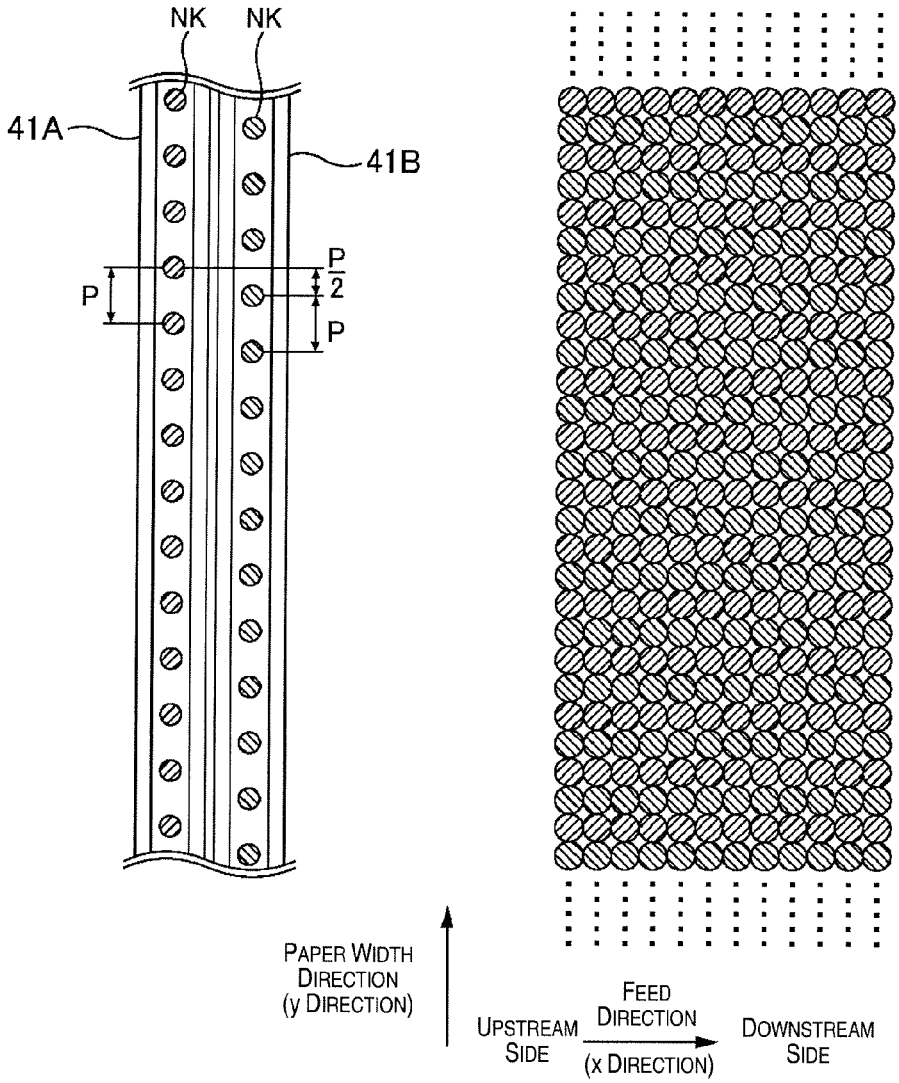
FIG. 7 is an explanatory drawing of the manner in which the heads are arranged and the dots are formed.

FIG. 7 is an explanatory drawing of the manner in which the heads are arranged and the dots are formed. To simplify the description, only two heads (the first head 41A and the second head 41B) in the head unit 40 are shown. Also, to simplify the description, the heads are provided only with black ink nozzle rows NK in this example. In the following description, the feed direction is referred to as the "x direction," and the paper width direction is referred to as the "y direction."

The black ink nozzle rows of the heads are configured from nozzles aligned in the paper width direction (the y direction) at intervals of 1/360 of an inch. In this drawing, an interval is shown as a dot pitch P.

The nozzles in the first head 41A and the nozzles in the second head 41B are disposed as being misaligned by P/2 with respect to the paper width direction. Although not shown in the drawing, the nozzles of the nozzle rows are also disposed so as to be misaligned by P/2 in the area where the end nozzle row of the second head 41B and a nozzle row of the third head 41C overlap.

A plurality of dot lines are formed on the paper by ink droplets being continuously discharged from the nozzles of such heads onto the paper S being conveyed. The dot lines are formed along the feed direction (the x direction). In this drawing, the nozzles of the first head 41A are shown with lines inclined left and downward, and the dots formed by the nozzles of the first head 41A are also shown with lines inclined left and downward. The nozzles of the second head 41B are shown with lines inclined right and downward, and the dots formed by the second head 41B are also shown with lines inclined right and downward.

With such an arrangement, the nozzle pitch of the nozzle rows is 360 dpi, but the dot pitch in the paper width direction can be 720 dpi. From the first head 41A to the twelfth head 41L, the heads are arranged so that dots are formed at a pitch of 720 dpi with respect to the paper width direction as shown in FIG. 7.

The size of the dots shown herein is varied by varying the drive voltage.

Figure 8:
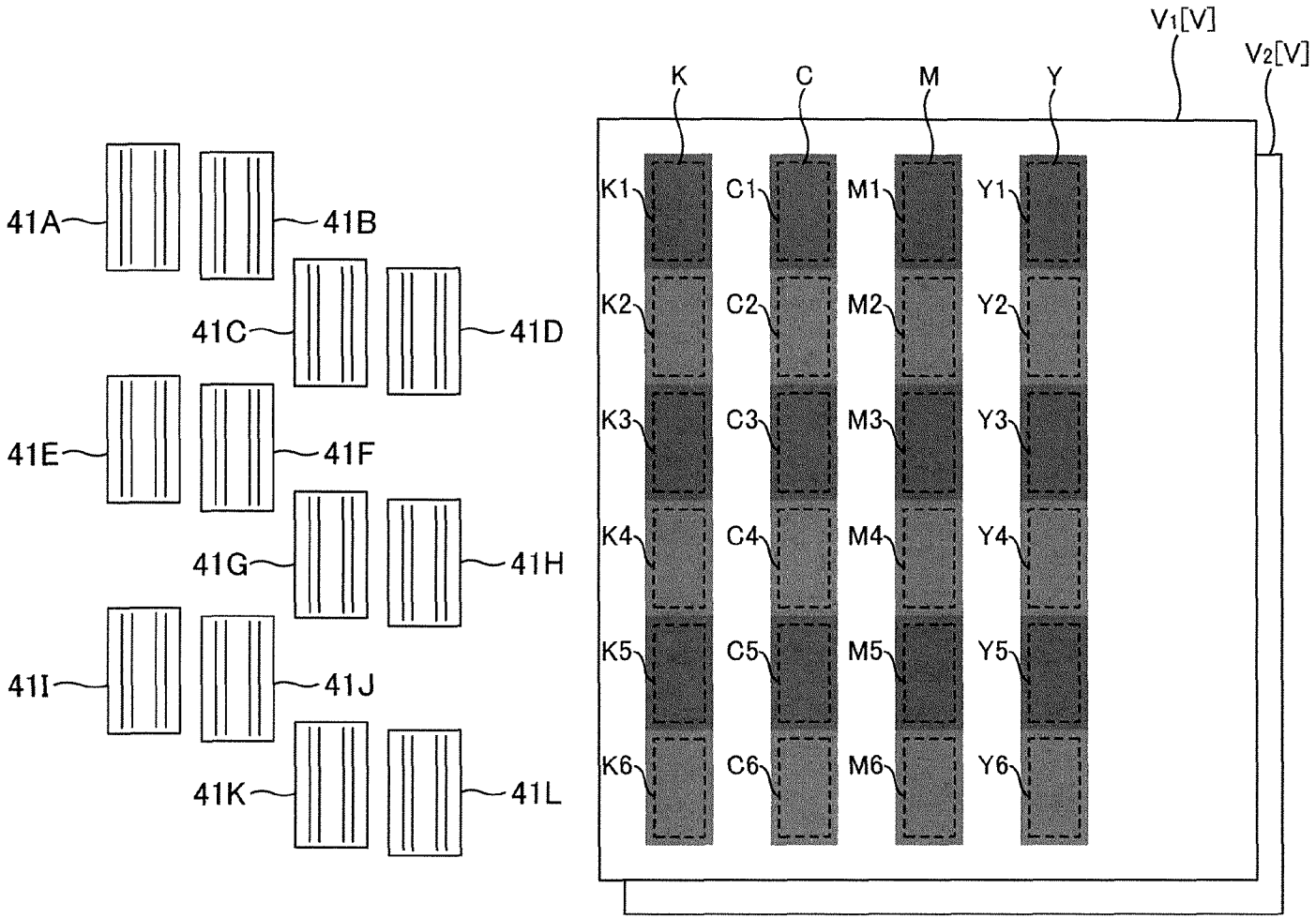
FIG. 8 is a drawing showing a test pattern in the present embodiment.

FIG. 8 is a drawing showing a test pattern in the present embodiment. The first through twelfth heads 41A to 41L are shown in this drawing. The nozzle rows which ordinarily are not visible from above are shown as visible here as well so that the nozzle row positioning can be understood. Two sheets of paper S are shown in this drawing, wherein a drive voltage V1 is shown on one paper S so as to show the formation of a test pattern when a common drive voltage of V1 has been set for the drive voltage Vh of the second drive pulse PS2 of the first through twelfth drive signals COM1 to COM12, and a drive voltage V2 is shown on the other paper S so as to show the formation of a test pattern when the drive voltage V2 has been set.

This drawing shows the test patterns formed by the heads for each ink color, as well as K1 to K6, C1 to C6, M1 to M6, and Y1 to Y6 as rectangular areas measured in color in the test patterns. The alphabetic letters of the symbols denote the ink colors of the rectangular areas. The numerals after the letters denote the numbers of the corresponding "bands."

The first band is formed by the first head 41A and the second head 41B. The second band is formed by the third head 41C and the fourth head 41D. The third band is formed by the fifth head 41E and the sixth head 41F. The fourth band is formed by the seventh head 41G and the eighth head 41H. The fifth band is formed by the ninth head 41I and the tenth head 41J. The sixth band is formed by the eleventh head 41K and the twelfth head 41L.

For example, the rectangular area of the black test pattern formed by the first head 41A and the second head 41B is denoted by the symbol K1.

The test patterns are formed while the paper S is being conveyed in the feed direction, and a test pattern including Y1 to Y6 is formed first by ink ejected from the yellow ink nozzle rows NY. Next, a test pattern including M1 to M6 is formed by ink ejected from the magenta ink nozzle rows NM. Next, a test pattern including C1 to C6 is formed by ink ejected from the cyan ink nozzle rows NC. Next, a test pattern including K1 to K6 is formed by ink ejected from the black ink nozzle rows NK.

When a test pattern is formed, one dot will inevitably be formed in an imaginary pixel area in the medium. In other words, dot lines formed by dots aligned in the feed direction are formed so as to be aligned at 720 dpi in the paper width direction, as shown in FIG. 7.

This drawing shows that the concentrations of the formed test patterns differ regardless of a common drive voltage Vh being set for all of the drive signals COM1 to COM12. This is because individual differences in the heads and other factors cause dots of different sizes to be formed even when the same drive voltage is applied, and as a result, test patterns of different concentrations are formed.

Figure 9:
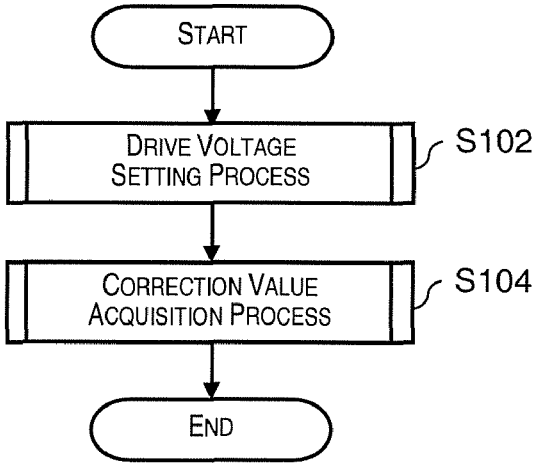
FIG. 9 is a flowchart for describing the drive voltage setting method in the present embodiment.

FIG. 9 is a flowchart for describing the drive voltage setting method in the present embodiment. As previously described, the first through twelfth heads 41A to 41L are used herein, but to simplify the description, the number of heads is reduced to six, the first through sixth heads 41A to 41F; and the band number is also reduced to three, the first through third bands.

First, the drive voltage setting process (S102) is performed.

Figure 10:
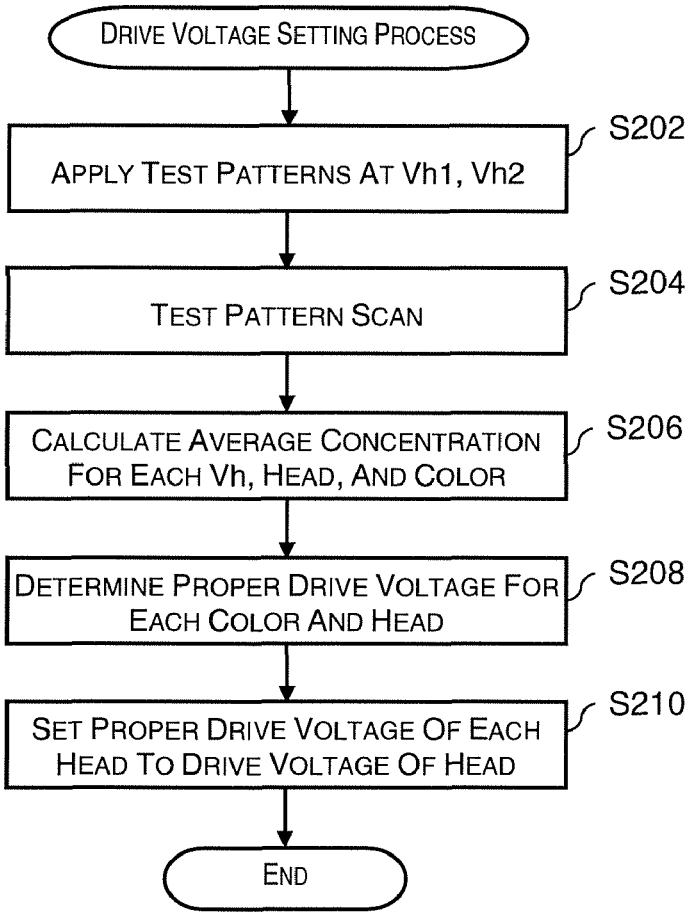
FIG. 10 is a flowchart for describing a concentration measurement process in relation to the drive voltage.

FIG. 10 is a flowchart for describing the drive voltage setting process. First, in the drive voltage setting process, test patterns of when the drive voltage is set to Vh1 and Vh2 are formed (S202). The test patterns applied are identical to the previously-described test patterns shown in FIG. 8, but a test pattern of when the drive voltage is set to Vh1 (22 V here) is applied to one sheet of paper, and a test pattern of when the drive voltage is set to Vh2 (25 V here) is applied to another sheet of paper.

Next, the printed test patterns are read by the scanner (S204). This reading is performed twice: once on the test patterns of when the drive voltage is Vh1, and once on the test patterns of when the drive voltage is Vh2. The RGB values for each head and each ink color are acquired in all the rectangular areas.

Next, the average concentration is determined for each drive voltage and each ink color (S206).

As previously described, it has been possible to obtain the RGB values by the reading of the test patterns by the scanner 120. Since the concentrations of the YMCK color spaces must be acquired, a process for converting the colors from RGB to YMCK is performed. For the conversion formulas, common conversion formulas such as those shown hereinbelow are used.

$$Y=(1-B/255-Kf)/(1-Kf)\times 255$$

$$M=(1-G/255-Kf)/(1-Kf)\times 255$$

$$C=(1-R/255-Kf)/(1-Kf)\times 255$$

$$K=Kf\times 255$$

In the above formulas, Kf=Min (1−R/255, 1−G/255, 1−B/255), and Min is a function which yields the minimum value inside the parentheses.

Through this process, the 256 tone concentration values in the pixel areas can be obtained. Other conversion formulas besides the above may also be used.

Through this process, the values of Y, M, C, and K in the pixel areas are determined as the concentrations, but only the concentrations of the corresponding ink colors are referenced for the rectangular areas of the ink colors. For the rectangular area K1, for example, only the concentration of black K determined in the above formula is referenced, and the concentration values of yellow Y, magenta M, and cyan C are ignored.

When the concentrations in the pixel areas are obtained, the average concentration for each drive voltage and ink color is determined. The average concentrations here are the average concentrations in the rectangular areas enclosed by the dashed lines in FIG. 8. In the present embodiment, since the scanner 120 is used to measure color, brightness values of pixel area units can be obtained, but the reliability of the concentration values obtained is increased by determining the average values of the rectangular areas enclosed by the dashed-line rectangles.

Specifically, the average concentration of the rectangular area K1 (the first band of black K) when the drive voltage Vh is 22 V is determined, for example. The average concentration is found by determining the average of the concentrations of black K in all of the pixel areas within K1.

This calculation of average concentration is performed when the drive voltage is 22 V and also when it is 25 V for K1 to K2, C1 to C3, M1 to M3, and Y1 to Y3.

FIG. 11 is a table showing the average concentrations of the determined bands and ink colors for each drive voltage. This table shows the average values of each ink color of each band for the drive voltages Vh1 and Vh2. As previously described, the first through third bands are dealt with herein in order to simplify the description. Referring to the table, lower concentration values are shown when the drive voltage is low (Vh1) than when the drive voltage is high (Vh2).

Next, the proper drive voltage is determined for each ink color of each band (S208). The proper drive voltage is the drive voltage needed in order to output the concentration that will be referenced for each ink color of each band. To determine the proper drive voltage, the reference concentrations of the ink colors are determined in advance. The reference concentrations are established in advance according to the specifics required in order to perform balanced color printing when taking into account the coloring of each ink color when color printing is performed.

FIG. 12 is a table showing the reference concentrations of the ink colors. The appropriate reference concentration values are established in this manner for each ink color used. The printer 1 is designed such that the desired color printing can be achieved by making it possible to appropriately perform this manner of printing using the reference concentrations.

The proper drive voltages can be determined by determining the drive voltages that yield reference concentrations, but in this case, the concentrations at the two drive voltages Vh1 and Vh2 already obtained are linearly interpolated, and the proper drive voltages are determined from these linearly interpolated concentration values.

The formula for a linearly interpolated line segment is obtained by a primary expression ($y=ax+b$). The coefficients a and b of the primary expression can be determined by correlating two primary equations for when the drive voltages Vh1 and Vh2 are substituted for x and the concentrations are substituted for y.

FIG. 13 is a table showing the determined coefficients a and b of the primary expression. This table shows the coefficients a and b of the heads of each ink color. According to this table, the primary expression for when the ink color of the first band is black K results in $y=3.30x+1.90$.

Next, the proper drive voltage of each ink color of each band is determined from the resulting primary expression. The proper drive voltage can be obtained by substituting the reference concentration value for y of the primary expression to find x. For example, since the primary expression of the first band when the ink color is black K was $y=3.30x+1.90$ as previously described, when the reference concentration 80.39 of black K is substituted for y to find the value of x, a proper drive voltage of 23.78 is obtained. The proper drive voltages of all the bands of the ink colors can be determined in the same manner.

FIG. 14 is a table showing the proper drive voltage of each ink color of each band. Due to individual differences in the heads, since different concentrations are outputted even when the same drive voltage is applied, the proper drive voltage is slightly different for each band.

Next, the average value of the proper drive voltage for each band is determined. With the first band, for example, the average values determined for the first band are a proper drive voltage of 23.78 for black K, a proper drive voltage of 23.52 for cyan, a proper drive voltage of 23.18 for magenta, and a proper drive voltage of 23.58 for yellow.

FIG. 15 is a table showing the proper drive voltages of the bands.

Next, the proper drive voltage of each head is determined based on the proper drive voltage of each band.

FIG. 16 is a table showing allocation coefficients of the heads. FIG. 17 is a table showing the proper drive voltages of the heads. In the present embodiment, the values obtained by multiplying the proper drive voltage values of the bands by these allocation coefficients of the heads are the proper drive voltages of the heads. For example, since the first head 41A corresponds to the first band, a first head allocation coefficient of 1.0 is multiplied by the first band proper drive voltage of 23.52. Specifically, the proper drive voltage of the first head 41A is 23.52.

The allocation coefficients may all be 1.0 when no other particular processing is used. When the proper drive voltage values have been determined for the inspection inks in the head inspection process, the higher the proper drive voltage values, the greater the allocation coefficients may be, because of the ratio of the values.

Based on the weight of the inks ejected when the heads form the predetermined test patterns, the allocation coefficients may be determined based on the ratio of the ink weights. The heads may also print ruled lines, and the allocation coefficients may be determined based on the ratio of the ruled line widths.

Dots are formed in one size in this case, but in a case in which dots of multiple sizes can be formed, test patterns may be prepared for each dot size, and drive voltages may be set for drive pulses for forming dots of each of the sizes.

Figure 18:
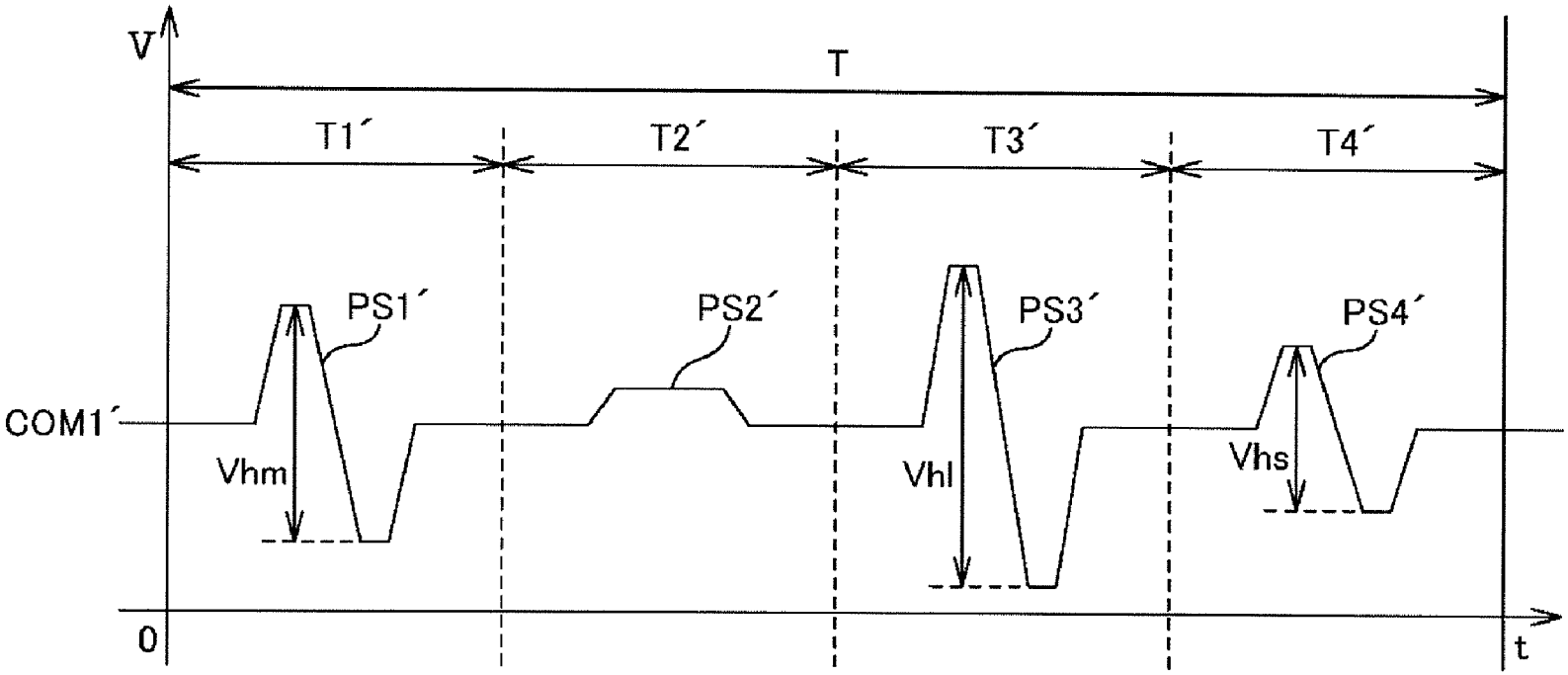
FIG. 18 is a graph showing an example of drive signals when dots of multiple sizes can be formed.

FIG. 18 is a graph showing an example of drive signals when dots of multiple sizes can be formed. In this case as well, first through twelfth drive signals COM1' to COM12' are outputted, and the drive signals are supplied to the corresponding heads. As in the case previously described, although the amplitudes of the drive pulses differ slightly between drive signals, the shapes of the drive signals are substantially the same, and therefore only the first drive signal COM1' will be described.

The first drive signal COM1' includes a first drive pulse PS1' for forming medium dots, a second drive pulse PS2' for causing minute vibrations in the ink meniscus, a third drive pulse PS3' for forming large dots, and a fourth drive pulse PS4' for forming small dots. When ink is not being ejected from the nozzles, only the second drive pulse PS2' is applied to the piezo element PZT. When ink for forming small dots is ejected from the nozzles, only the fourth drive pulse PS4' is applied to the piezo element PZT. When ink for forming medium dots is ejected from the nozzles, only the first drive pulse PS1' is applied to the piezo element PZT. When ink for forming large dots is ejected from the nozzles, the third drive pulse PS3' is applied to the piezo element PZT.

This graph shows the drive voltage Vhm of the first drive pulse PS1', the drive voltage Vh1 of the third drive pulse PS3', and the drive voltage Vhs of the fourth drive pulse PS4', and the relationship of magnitude between these voltages is Vh1>Vhm>Vhs. In other words, the greater the drive voltage, the larger the dots that can be formed.

Thus, when small dots, medium dots, and large dots can be formed, reference concentrations such as those shown in FIG. 12 are prepared for the three dot sizes small, medium, and large. The same method as that described above is applied for these reference concentrations. In other words, Vhs is adjusted so as to achieve the reference concentration for small dots, Vhm is adjusted so as to achieve the reference concentration for medium dots, and Vh1 is adjusted so as to achieve the reference concentration for large dots.

Through this process, the difference in concentration between heads can be reduced in a printer capable of forming dots of multiple sizes.

Figure 19:
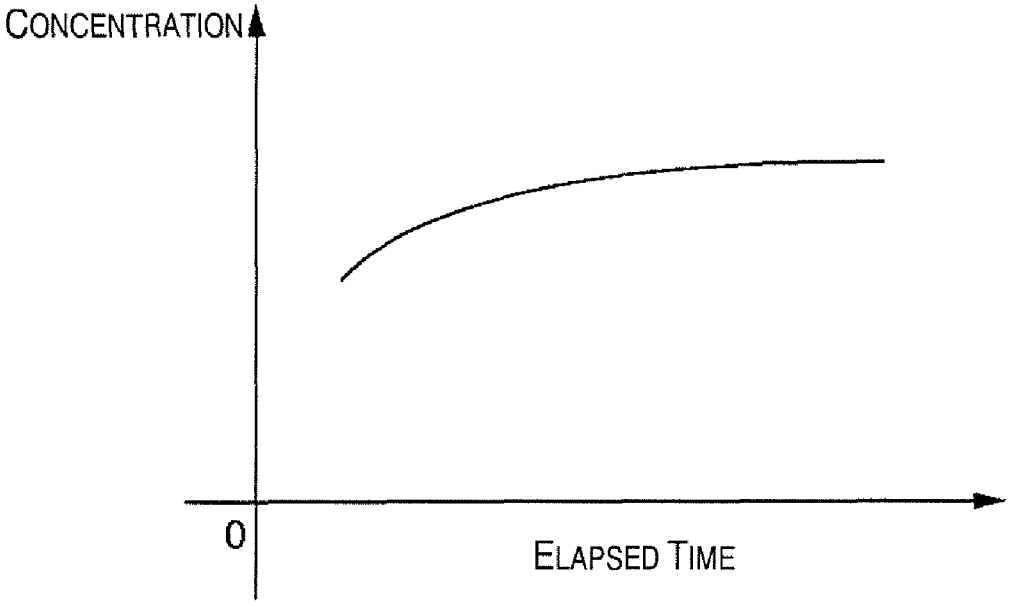
FIG. 19 is a graph showing a relationship between elapsed time and concentration.

FIG. 19 is a graph showing the relationship between elapsed time and concentration. Normally when the concentration is measured, the measurement must be performed after the ink has been sufficiently dried. However, there are cases, depending on the ink used, in which the concentration increases with the passage of time after the dots are formed on the medium, as shown in the graph. The concentration may be measured after the ink has been sufficiently dried, but in this case, some time period must be allowed to pass before the measurement is performed.

Consequently, in such cases, a relationship between elapsed time and concentration such as the one shown in the graph may be acquired in advance. The concentration originally intended to be measured may be acquired based on the time elapsed from the printing of the test patterns until the concentration measurement, and also based on the measured concentration.

Through this process, the concentration difference between bands can be reduced, and as a result, the concentration difference between heads can be reduced, but since the average values of the proper drive voltages of all the ink colors of each band are set as the proper drive voltages of the respective bands as described above, there may be cases in which a concentration difference arises despite extremely small amounts being used. Since such concentration differences occur in the band units, the concentration difference between bands can be further reduced if a concentration correction is performed for the row area units composed of pixel areas aligned in the feed direction. Below is a description of the method for performing a concentration correction with row area units composed of pixel areas aligned in the feed direction.

Process With Printer Driver

Figure 20:
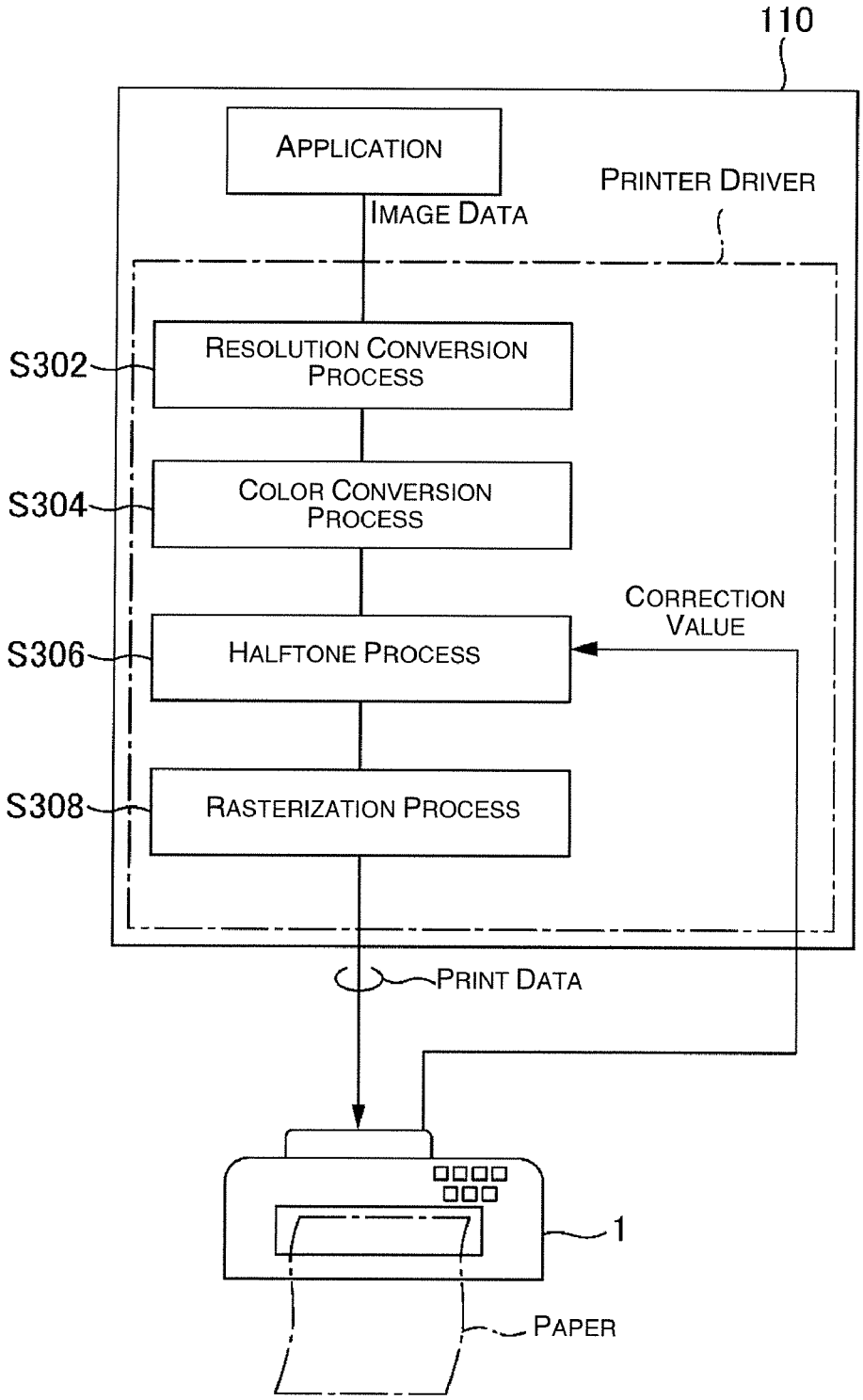
FIG. 20 is an explanatory chart of a process with a printer driver.

FIG. 20 is an explanatory chart of the process with the printer driver. The process with the printer driver is described hereinbelow while referring to this chart.

Print image data is created by the printer driver performing a resolution conversion process (S302), a color conversion process (S304), a halftone process (S306), and a raster line process (S308), as shown in the chart.

First, in the resolution conversion process, the resolution of RGB image data obtained by performing the application program is converted to a print resolution corresponding to the designated image quality. Next, in the color conversion process, the RGB image data whose resolution has been converted is then converted to CMYK image data. The term "CMYK image data" herein refers to image data designated by color, for cyan (C), magenta (M), yellow (Y), and black (K). Multiple pieces of image data constituting the CMYK image data are expressed as the tone values of 256 levels. These tone values are established based on the RGB image data, and are also referred to as directive tone values hereinbelow.

Next, in the halftone process, the multi-level tone values indicated by the pixel data constituting the image data are converted to dot tone values of few levels capable of being achieved by the printer 1. The 256-level tone values indicated by the pixel data are converted to two-level dot tone values. Specifically, the values are converted to two levels which are "no dot" corresponding to a dot tone value of "00," and "dot" corresponding to a dot tone value of "01."

In cases in which dots of multiple sizes can be formed, the values may be converted to four levels: "no dot" corresponding to a dot tone value of "00," "form small dot" corresponding to a dot tone value of "01," "form medium dot" corresponding to a dot tone value of "10," and "form large dot" corresponding to a dot tone value of "11."

Thereafter, upon establishing a dot creation rate for each dot size, image data is created using dithering so that the printer 1 forms a dispersion of dots.

Next, in a rasterizing process, dot data in the image data obtained in the halftone process is converted to a data sequence which will be transferred to the printer 1. The rasterized data is then transmitted as part of the print data.

Concentration Discrepancies

Figure 21A:
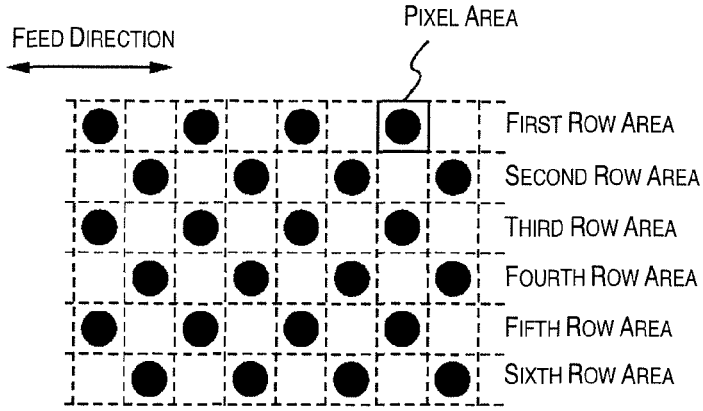
FIG. 21A is an explanatory diagram of the outcome when dots are formed ideally, as well as an explanatory diagram of when there are concentration discrepancies.

FIG. 21A is an explanatory diagram of the outcome when dots are formed ideally. The term "dots are formed ideally" refers to ink droplets being deposited in center positions in the pixel areas, the ink droplets widening on the paper S, and dots being formed in the pixel areas. When dots are formed accurately in the pixel areas, dot lines (dot rows in which dots are aligned in the feed direction) are formed accurately in the row areas.

Figure 21B:
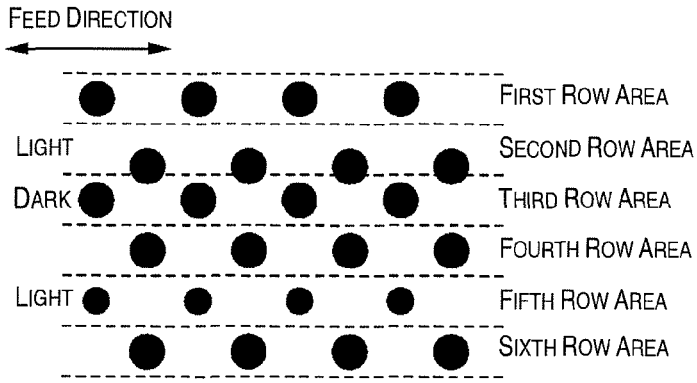
FIG. 21B is an explanatory diagram of when there are concentration discrepancies.

FIG. 21B is an explanatory diagram of when there are concentration discrepancies. The dot line formed in the second row area is formed nearer to the third row area due to nonuniformity in the projected direction of ink droplets discharged from the nozzles. As a result, the second row area is lighter, and the third row area is darker. The ink quantity of ink droplets discharged from the fifth row area is less than the stipulated ink quantity, and the dots formed in the fifth row area are smaller. As a result, the fifth row area is lighter.

When a printed image composed of raster lines of different darkness/lightness is viewed at a macroscopic level, streaked concentration discrepancies in the feed direction can be seen. These concentration discrepancies are the cause of reduced quality of the printed image.

Correcting the tone values (the directive tone values) of the image data is a possible measure for suppressing such concentration discrepancies as described above. In other words, the tone values of pixels corresponding to unit areas constituting row areas can be corrected so that row areas appearing as dark (light) can be formed lighter (darker). Therefore, a concentration correction value H for correcting the tone values of image data is calculated for each raster line. The concentration correction value H is a value that reflects the concentration discrepancy characteristic of the printer 1.

Figure 21C:
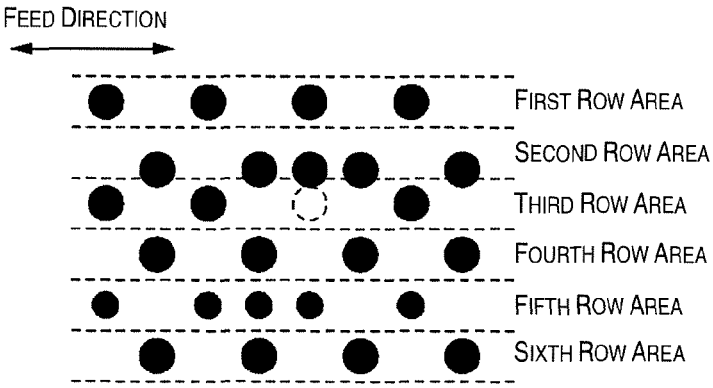
FIG. 21C is a diagram showing the outcome when the occurrence of concentration discrepancies has been suppressed.

FIG. 21C is a diagram showing the outcome of suppressing the occurrence of concentration discrepancies. If the concentration correction value H is calculated for every raster line, the printer driver performs a process for correcting the tone values of the pixel data for each raster line based on the concentration correction value H when the halftone process is performed. When dot lines are formed with tone values corrected by this correction process, the concentrations of the corresponding raster lines are corrected, the result of which is that the occurrence of concentration discrepancies in the printed image is suppressed as shown in FIG. 21C.

For example, in FIG. 21C, the pixel data tone values of the pixels corresponding to each row area are corrected so that there is a higher creation rate of lighter-appearing dots in the second and fifth row areas, and a lower creation rate of darker-appearing dots in the third row area. Thus, the dot creation rates of the raster lines of the row areas are changed, the concentrations of image pieces of the row areas are corrected, and concentration discrepancies throughout the entire printed image are suppressed.

Calculating the Concentration Correction Value H

Next, the process of calculating the concentration correction value H for each raster line (hereinbelow also referred to as the correction value acquisition process) will be summarized. The correction value acquisition process is performed within a correction value calculation system in an inspection line at the site where the printer 1 is manufactured. The correction value calculation system is a system for calculating the concentration correction value H according to the concentration discrepancy characteristics of the printer 1, and is configured similar to the print system 100 described above. In other words, the correction value calculation system has a printer 1, a computer 110, and a scanner 120 (the same symbols as those of the print system 100 are used for the sake of convenience.

The printer 1 is the target device of the correction value acquisition process, and a concentration correction value H for the printer 1 is calculated during the correction value acquisition process in order to print an image with no concentration discrepancies using the printer 1. The computer 110 placed on the inspection line has a correction value calculation program installed whereby the computer 110 performs the correction value acquisition process.

The Correction Value Acquisition Process (S104)

Figure 22:
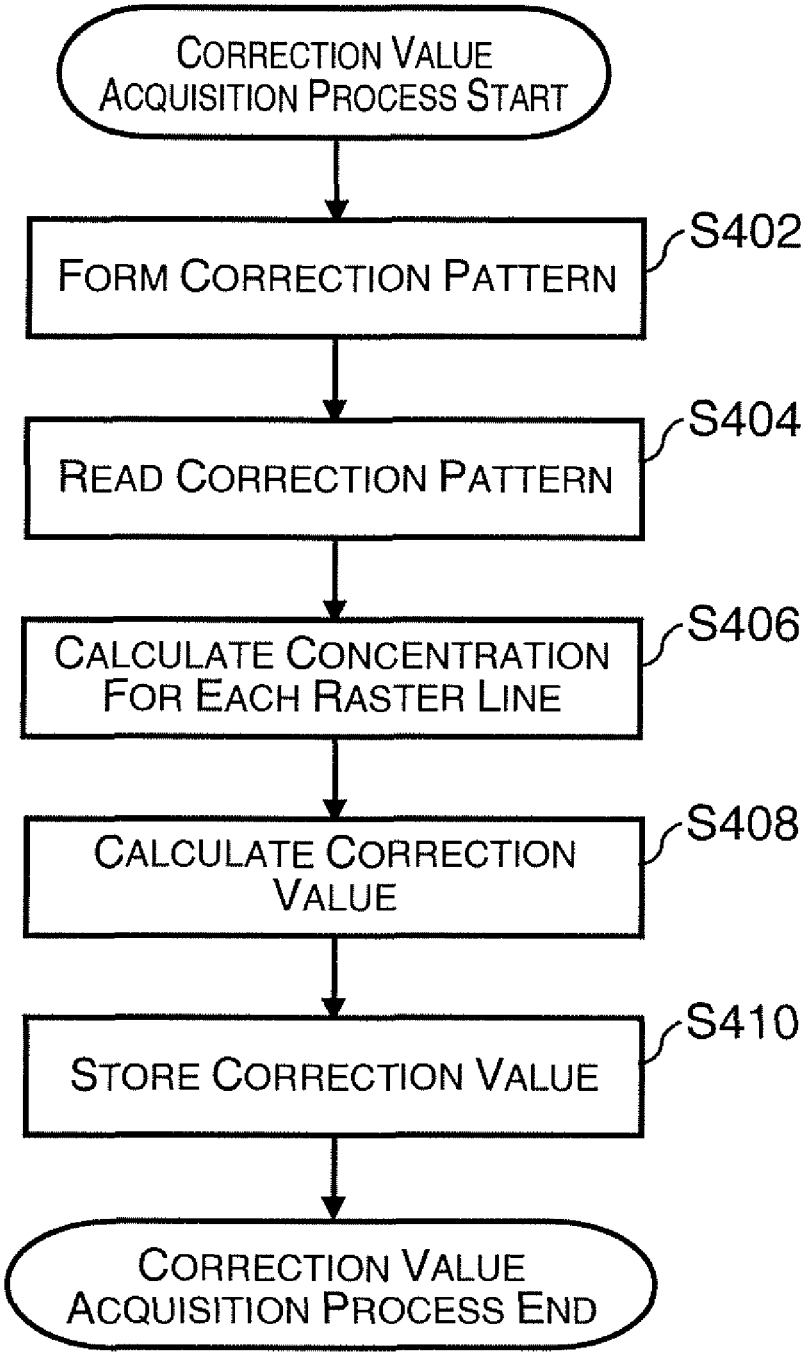
FIG. 22 is a chart showing the flow of a correction value acquisition process.

FIG. 22 is a chart showing the flow of the correction value acquisition process. When a printer 1 capable of multicolor printing is the target, a correction value acquisition process for each ink color is performed by the same procedure. In the following description, a correction value acquisition process for a single ink color (e.g. black) is described.

First, the computer 110 sends print data to the printer 1, and the printer 1 forms a correction pattern CP on the paper S by the same procedure as the printing action described previously (S402).

Figure 23:
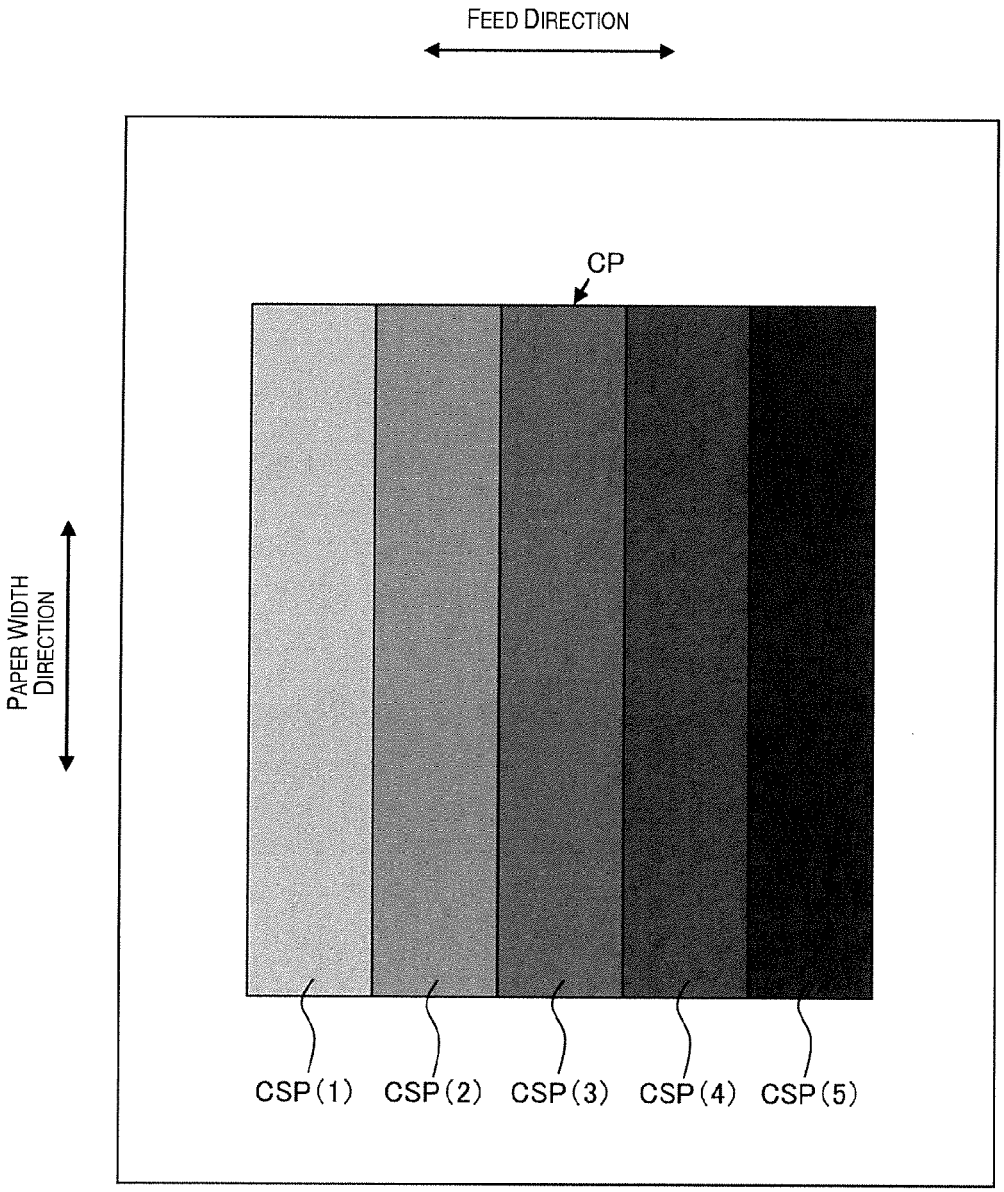
FIG. 23 is an explanatory drawing of a correction pattern CP.

FIG. 23 is an explanatory drawing of the correction pattern CP. The correction pattern CP is formed from five sub patterns CSP of different concentrations as shown in FIG. 23.

The sub patterns CSP are belt-shaped patterns, and are configured by raster lines extending in the feed direction being aligned in the paper width direction. The sub patterns CSP are created from the image data of specified tone values (directive tone values), and there concentrations increase sequentially from the left sub pattern CSP as shown in FIG. 23. Specifically, the concentrations of the sub patterns from the left are 15%, 30%, 45%, 60%, and 85%. Hereinbelow, the directive tone value of the sub pattern CSP of 15% concentration is denoted as Sa, the directive tone value of the sub pattern CSP of 30% concentration is denoted as Sb, the directive tone value of the sub pattern CSP of 45% concentration is denoted as Sc, the directive tone value of the sub pattern CSP of 60% concentration is denoted as Sd, and the directive tone value of the sub pattern CSP of 85% concentration is denoted as Se. The sub pattern CSP formed with the directive tone value Sa, for example, is denoted by CSP(1) as shown in FIG. 23. Similarly, the sub patterns CSP formed with the directive tone values Sb, Sc, Sd, and Se are denoted respectively by CSP(2), CSP(3), CSP(4), and CSP(5).

Next, the inspector sets the paper S on which the correction pattern CP is formed on the scanner 120. The computer 110 reads the correction pattern CP from the scanner 120 and acquires the result (S404). The scanner 120 has three sensors corresponding to the colors R (red), G (green), and B (blue) as previously described, and the scanner radiates light onto the correction pattern CP and detects the reflected light by sensors. The computer 110 makes adjustments to the image data from which the correction pattern was read so that the number of pixel rows in which pixels are aligned in a direction equivalent to the feed direction and the number of raster lines (number of row areas) constituting the correction pattern are the same number. In other words, the pixel rows and row areas read by the scanner 120 are made to correspond one-to-one. The average value of the read tone values exhibited by the pixels of the pixel row corresponding to a certain row area is used as the read tone value of that row area.

Next, based on the read tone values acquired by the scanner 120, the computer 110 calculates the concentration of each raster line (each row area, in other words) of each sub pattern CSP (S406). The concentrations calculated based on the read tone values are hereinbelow also referred to as calculated concentrations.

Figure 24:
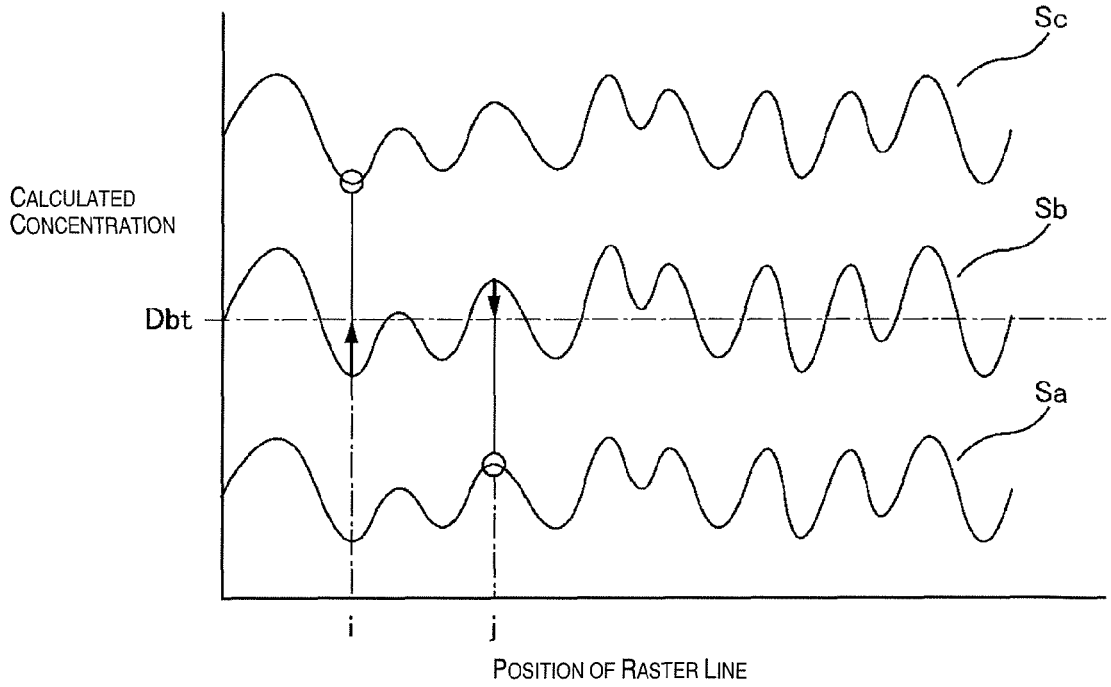
FIG. 24 is a graph showing the calculated concentration of each raster line for sub patterns CSP having directive tone values Sa, Sb, and Sc.

FIG. 24 is a graph showing the calculated concentration of each raster line for the sub patterns CSP having the directive tone values Sa, Sb, and Sc. The horizontal axis in FIG. 24 represents the position of the raster line, and the vertical axis represents the extent of the calculated concentration. The sub patterns CSP have some degree of darkness or lightness in each raster line regardless if the sub patterns are formed form the same directive tone value, as s shown in FIG. 24. The difference in darkness or lightness of the raster lines is the cause of concentration discrepancies in the printed image.

Next, the computer 110 calculates the concentration correction value H of each raster line (S408). The concentration correction value H is calculated for each directive tone. The concentration correction values H calculated for the directive tones Sa, Sb, Sc, Sd, and Se are hereinbelow denoted respectively as Ha, Hb, Hc, Hd, and He. To describe the procedure of calculating the concentration correction values H, the example used in this description is a procedure for calculating the concentration correction value Hb for correcting the directive tone value Sb so that the calculated concentration is constant for each raster line of the sub pattern CSP(2) having the directive tone value Sb. In this procedure, the average value Dbt of the calculated concentrations of all raster lines in the sub pattern CSP(2) having the directive tone value Sb, for example, is established as the target concentration of the directive tone value Sb. In FIG. 24, the ith raster line whose calculated concentration is lighter than the target concentration Dbt is preferably corrected so that the directive tone value Sb is made darker. The jth raster line, whose calculated concentration is darker than the target concentration Dbt, is preferably corrected so that the directive tone value Sb is made lighter.

Figure 25A:
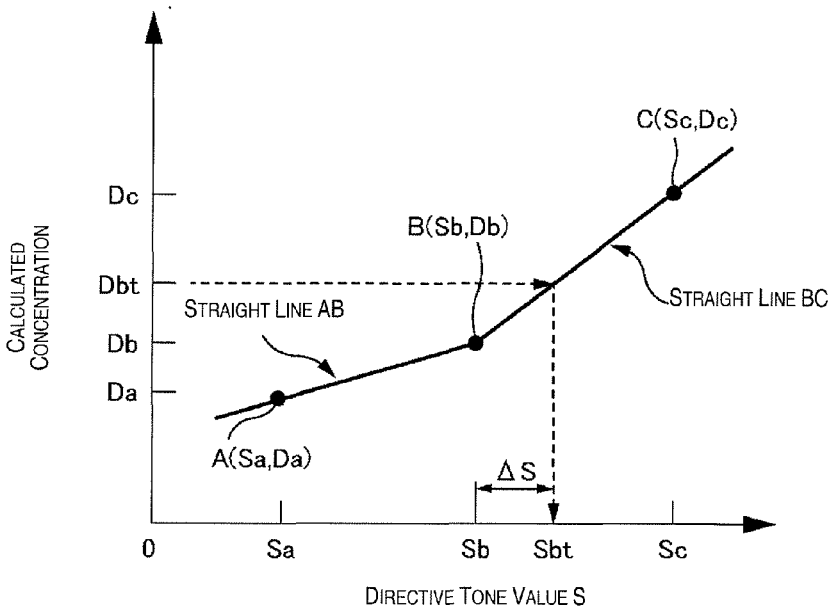
FIG. 25A is an explanatory drawing of a procedure for calculating a concentration correction value Hb for correcting a directive tone value Sb for an ith raster line.
Figure 25B:
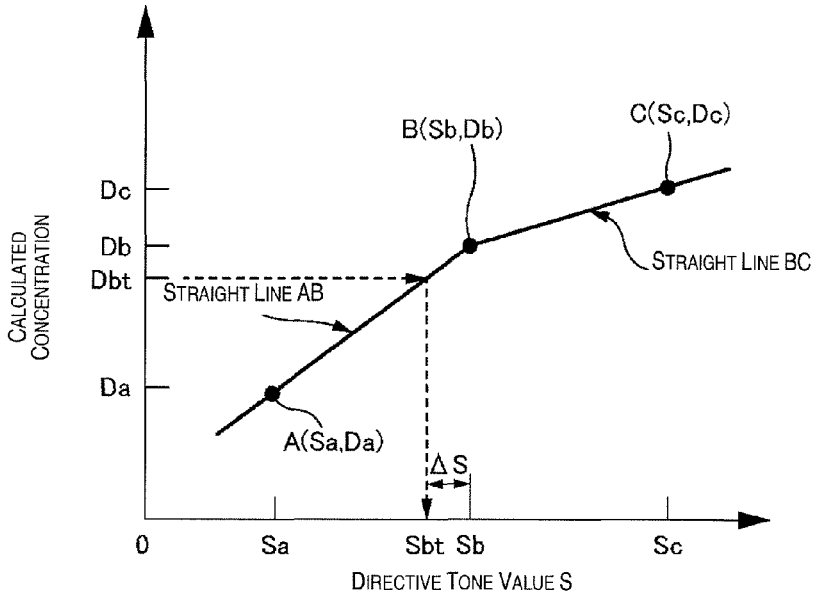
FIG. 25B is an explanatory drawing of a procedure for calculating a concentration correction value Hb for correcting a directive tone value Sb for a jth raster line.

FIG. 25A is an explanatory drawing of the procedure for calculating the concentration correction value Hb for correcting the directive tone value Sb for the ith raster line. FIG. 25B is an explanatory drawing of the procedure for calculating the concentration correction value Hb for correcting the directive tone value Sb for the jth raster line. The horizontal axes in FIGS. 25A and 25B represent the size of the directive tone values and the vertical axes represent the calculated concentration.

The concentration correction value Hb for the directive tone value Sb of the ith raster line is calculated based on the calculated concentration Db of the ith raster line in the sub pattern CSP(2) having the directive tone value Sb shown in FIG. 25A, and also based on the calculated concentration Dc of the ith raster line in the sub pattern CSP(3) having the directive tone value Sc. More specifically, in the sub pattern CSP(2) of the directive tone value Sb, the calculated concentration Db of the ith raster line is less than the target concentration Dbt. In other words, the concentration of the ith raster line is lighter than the average concentration. If the intention is to form the ith raster line so that the calculated concentration Db of the ith raster line is equal to the target concentration Dbt, a tone value of pixel data corresponding to the ith raster line, i.e. the directive tone value Sb is preferably corrected to a target directive tone value Sbt calculated by the following formula (1), using a linear approximation from the correlation (Sb, Db), (Sc, Dc) between the directive tone values and the calculated concentrations in the ith raster line, as shown in FIG. 25A.

$$Sbt=Sb+(Sc-Sb)\times\{(Dbt-Db)/(Dc-Db)\} \quad (1)$$

A concentration correction value H for correcting the directive tone value Sb in the ith raster line is then determined by the following formula (2) from the target directive tone value Sbt of the directive tone value Sb.

$$Hb=\Delta S/Sb=(Sbt-Sb)/Sb \quad (2)$$

The concentration correction value Hb for the directive tone value Sb of the jth raster line is calculated based on the calculated concentration Db of the jth raster line in the sub pattern CSP(2) of the directive tone value Sb shown in FIG. 25B, and also based on the calculated concentration Da of the jth raster line in the sub pattern CSP(1) of the directive tone value Sa. Specifically, in the sub pattern CSP(2) of the directive tone value Sb, the calculated concentration Db of the jth raster line is greater than the target concentration Dbt. If the intention is to form the jth raster line so that the calculated concentration Db of the jth raster line is equal to the target concentration Dbt, the directive tone value Sb of the jth raster line is preferably corrected to a target directive tone value Sbt calculated by the following formula (3), using a linear approximation from the correlation (Sa, Da), (Sb, Db) between the directive tone values and the calculated concentrations in the jth raster line, as shown in FIG. 25B.

$$Sbt=Sb+(Sb-Sa)\times\{(Dbt-Db)/(Db-Da)\} \quad (3)$$

The concentration correction value Hb for correcting the directive tone value Sb for the jth raster line is determined from the above formula (2).

As described above, the computer 110 calculates the concentration correction value Hb for the directive tone value Sb for each raster line. Similarly, the concentration correction values Ha, Hc, Hd, and He for the directive tone values Sa, Sc, Sd, and Se are respectively calculated for each raster line. The concentration correction values Ha to He for the respective directive tone values Sa to Se are also calculated for each raster line for the other ink colors.

The computer 110 then transmits the data of the concentration correction values H to the printer 1 and stores the data in the memory 63 of the printer 1 (S410).

FIG. 26 is a diagram showing a correction value table stored in the memory 63. As a result, a correction value table is created in the memory 63 of the printer 1, wherein the concentration correction values Ha to He for the five respective directive tone values Sa to Se are compiled for each raster line, as shown in FIG. 26.

A correction value table is created for each ink color as shown in FIG. 26. As a result, correction value tables are formed for the four colors CMYK. These correction value tables are referred to by the printer driver in order to correct the tone values of the raster lines constituting the image data of the image when an image is printed using the printer 1.

In the present embodiment, the concentration is measured with each raster line corresponding to the pixel rows on the paper, and a correction value for correcting the tone value is determined based on the measured concentration. In this manner, concentration correction can be performed for each raster line. The occurrence of color discrepancies on the paper can be suppressed.

Printing Process

Figure 27:
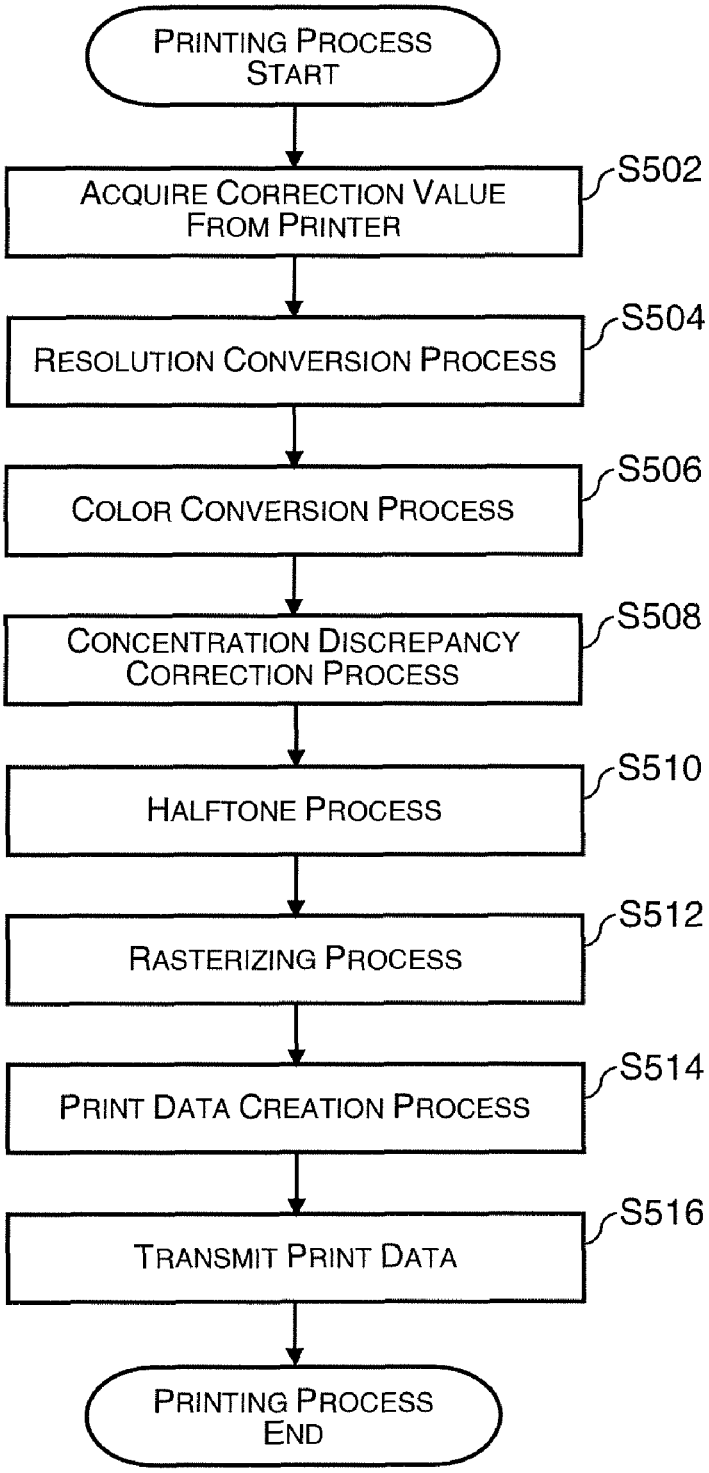
FIG. 27 is a flowchart of the printing process performed by a printer driver under the direction of a user.

FIG. 27 is a flowchart of the printing process performed by the printer driver under the direction of a user. The user who has purchased the printer 1 installs a printer driver stored in a CD-ROM included with the printer 1 (or a printer driver downloaded from the homepage of the printer manufacturing company) in the computer. This printer driver includes codes for executing the processes shown in the drawings on the computer. The user connects the printer 1 to the computer.

First, the printer driver acquires from the printer 1 the correction value table (see FIG. 26) stored in the memory of the printer 1 (S502).

When the user has issued an instruction for printing from the application program, the printer driver is called up, image data (printed image data) that will be the print target is received from the application program and a resolution conversion process is performed on the printed image data (S504). The resolution conversion process is a process for converting the image data (text data, image data, etc.) to a resolution for printing on the paper (the print resolution). The print resolution here is 360×360 dpi, and the pixel data after the resolution conversion process is 256 tone data represented by RGB color spaces.

Next, the printer driver performs a color conversion process (S506). The color conversion process is a process for converting image data in accordance with the color spaces of the ink colors of the printer 1. The image data (256 tones) of the RGB color spaces is converted to image data (256 tones) of CMYK spaces.

Image data of the 256 tone CMYK color spaces is thereby obtained. To simplify the following description, only the image data of a black flat surface is described out of the image data of the CMYK color spaces.

Next, the printer driver performs a concentration discrepancy correction process (S508). The concentration discrepancy correction process is a process for correcting the tone values of pixel data belonging to the pixel rows based on the correction values of pixel row (corresponding to the raster lines) on the paper.

For example, the printer driver of the computer 110 of the user corrects the tone values of the pixel data (hereinbelow, the tone values before correction are referred to as Sin) based on the concentration correction value H of the raster line to which the pixel data corresponds (hereinbelow, the tone values after correction are referred to as Sout).

Specifically, if the tone value Sin of a certain raster line is the same as any of the directive tone values Sa, Sb, Sc, Sd, or Se, the concentration correction value H stored in the memory of the computer 110 can be used as is. For example, if the tone value Sin of the pixel data is equal to Sb, the tone value Sout after correction is determined by the following formula.

$$Sout=Sb\times(1+Hb)$$

When the tone value of the pixel data is different from the directive tone values Sa, Sb, Sc, Sd, and Se, the correction value is calculated based on interpolation using the concentration correction values of the surrounding directive tone values. For example, in a case in which the directive tone value Sin is between the directive tone value Sb and the directive tone value Sc, when H' denotes a correction value determined by linear interpolation using the concentration correction value Hb of the directive tone value Sb and the concentration correction value Hc of the directive tone value Sc, the tone value Sout after correction of the directive tone value Sin is determined by the following formula.

$$Sout=Sin\times(1+H')$$

In this manner is the concentration correction process performed.

After the concentration discrepancy correction process, the printer driver performs a halftone process. The halftone process is a process for converting high-tone data to low-tone data. In this case, 256 tone print image data is converted to 2 tone print image data which the printer 1 is capable of achieving. Dithering is a known possible example of the halftone process method and the present embodiment also performs this manner of halftone process.

In the present embodiment, the printer driver performs the halftone process on the pixel data that has undergone the concentration discrepancy correction process. As a result, the tone values of the pixel data in the visibly darker portions are corrected so as to be lower, and the dot creation rate in these portions therefore decreases. Conversely, the dot creation rate increases in the visibly lighter portions.

Next, the printer driver performs a rasterizing process (S512). The rasterizing process is a process for converting the alignment sequence of the pixel data in the print image data to the data sequence that will be transferred to the printer 1. The printer driver then creates print data by adding control data for controlling the printer 1 to the pixel data (S514), and transmits the print data to the printer 1 (S516).

The printer 1 performs the printing action in accordance with the received print data. Specifically, the controller 60 of the printer 1 controls the feed unit 20 and other components in accordance with the control data of the received print data, and controls the head unit 40 in accordance with the pixel data of the print data to discharge ink from the nozzles. If the printer 1 performs the printing process based on the print data created in this manner, the dot creation rates of the raster lines are changed, the concentrations of the image pieces of the row areas on the paper are corrected, and concentration discrepancies in the printed image are suppressed.

Other Embodiments

In the embodiment described above, a printer 1 was described as a fluid ejection device, but the fluid ejection device is not limited to this example and can also be specified as a fluid ejection device which ejects or discharged fluid other than ink (liquids, liquid substances in which particles of a functional material have been dispersed, and fluids such as gels). For example, the same technology as the embodiment described above may be applied to various devices that employ inkjet technology, such as color filter manufacturing devices, dyeing devices, microfabrication devices, semiconductor manufacturing devices, surface machining devices, three-dimensional modeling devices, gasification devices, organic EL manufacturing devices (macromolecular EL manufacturing devices in particular), display manufacturing devices, film formation devices, and DNA chip manufacturing devices. These methods and manufacturing methods also fall under the category of the applicable range.

The embodiment described above is intended to make the present invention easier to understand, and should not be interpreted as limiting the present invention. The present invention can be modified and improved as long as there is no deviation from the scope of the invention, and the present invention of course includes all equivalents thereof.

Head

As a method for ejecting ink as in the embodiment previously described, ink can be ejected using piezoelectric elements. However, the system for ejecting liquid is not limited to this example. For example, a system for creating bubbles in the nozzles by heat or other systems may also be used.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A detection method for detecting adjustment values of a fluid ejection device having first and second heads with the first head disposed on an upstream side of the second head in a feed direction in which a medium is conveyed, the second head forming dot rows of a fluid between dot rows of the fluid formed by the first head, the detection method comprising:

driving the first head and the second head with a first voltage change amount to form a first test pattern and driving the first head and the second head with a second voltage change amount to form a second test pattern;

measuring a concentration of the first test pattern and a concentration of the second test pattern;

adjusting the first voltage change amount for driving the first head and the second voltage change amount for driving the second head based on the concentration of the first test pattern and the concentration of the second test pattern, the adjusting of the voltage change amount for driving the first head and the voltage change amount for driving the second head including adjusting the first and second voltage change amount corresponding to a target concentration based on the concentration of the first test pattern and the concentration of the second test pattern.

2. The detection method according to claim 1, wherein the adjusting of the first voltage change amount for driving the first head and the second voltage change amount for driving the second head includes adjusting the first voltage change amount for driving the first head and the second voltage change amount for driving the second head based on voltage change amount corresponding to the target concentration, and an allocation coefficient determined in advance based on relative fluid ejection amounts of the first head and the second head.

3. The detection method according to claim 2, wherein the allocation coefficient is determined based on weights of the fluid ejected by the first head and the second head.

4. The detection method according to claim 2, wherein the allocation coefficient is determined based on widths of ruled lines formed by the first head and the second head.

5. The detection method according to claim 1, wherein the voltage change amounts are amplitudes of drive pulses included in drive signals for driving the heads.

6. The detection method according to claim 1, wherein the voltage change amounts are maximum amplitudes of drive pulses included in drive signals for driving the heads.

7. The detection method according to claim 1, wherein the first test pattern and the second test pattern are test patterns with which dots are formed in all of pixels in a predetermined area.

8. The detection method according to claim 7, further comprising forming a corrective pattern on the medium to correct a concentration in each pixel row composed of pixels aligned in the feed direction, and determining concentration correction values for correcting the concentration of each pixel row based on the corrective pattern, the concentration of the corrective pattern being measured for each pixel row, and the concentration correction values being determined based on the concentration of each pixel row.

9. A fluid ejection device comprising:

a first head disposed on an upstream side in a feed direction in which a medium is conveyed; and a second head disposed on a downstream side of the first head, the second head being configured to form dot rows of a fluid between dot rows of the fluid formed by the first head, the fluid ejection device being adjusted according to the adjustment values detected by the detection method according to claim 1.

* * * * *